US010344590B1

(12) United States Patent
Young et al.

(10) Patent No.: US 10,344,590 B1
(45) **Date of Patent: *Jul. 9, 2019**

(54) MEASUREMENT WHILE DRILLING APPARATUS AND METHOD OF USING THE SAME

(71) Applicants: Allen R. Young, Houston, TX (US); Brad Reeves, Edmond, OK (US)

(72) Inventors: Allen R. Young, Houston, TX (US); Brad Reeves, Edmond, OK (US)

(73) Assignee: National Oilwell DHT, LP, Houston, TX (US)

( * ) Notice: Subject to any disclaimer, the term of this patent is extended or adjusted under 35 U.S.C. 154(b) by 50 days.

This patent is subject to a terminal disclaimer.

(21) Appl. No.: 15/348,088

(22) Filed: Nov. 10, 2016

Related U.S. Application Data

(63) Continuation-in-part of application No. 13/906,588, filed on May 31, 2013, now abandoned, which is a continuation of application No. 13/417,695, filed on Mar. 12, 2012, now Pat. No. 8,474,548, which is a continuation-in-part of application No. 12/799,762, filed on Apr. 30, 2010, now Pat. No. 8,251,160, which is a continuation of application No. 11/518,648, filed on Sep. 11, 2006, now Pat. No. 7,735,579.

(60) Provisional application No. 60/716,268, filed on Sep. 12, 2005.

(51) Int. Cl.
*E21B 47/18* (2012.01)
*E21B 47/022* (2012.01)

(52) U.S. Cl.
CPC ..... *E21B 47/18* (2013.01); *E21B 47/022* (2013.01)

(58) Field of Classification Search
CPC ... E21B 7/04; E21B 7/046; E21B 7/06; E21B 7/10; E21B 44/00; E21B 45/00; E21B 47/00; E21B 45/01; E21B 47/187; E21B 47/18; E21B 47/022; E21B 47/09; E21B 47/0915
See application file for complete search history.

(56) References Cited

U.S. PATENT DOCUMENTS 8,474,548 B1 * 7/2013 Young ..... E21B 47/187 175/40
2005/0161258 A1 * 7/2005 Lockerd, Sr. ..... E21B 44/005 175/45

* cited by examiner

*Primary Examiner* — Brad Harcourt
(74) *Attorney, Agent, or Firm* — Phillips Murrah PC; Martin G. Ozinga

(57) ABSTRACT

The present invention is a method and apparatus used to transmit information to the surface from a subsurface location during the process of drilling a bore hole comprising a pressure pulse generator or "pulser" coupled to a sensor package, a controller, an active electromagnetic system for subsurface collision avoidance, and a battery power source all of which reside inside a short section of drill pipe close to the bit at the bottom of the bore hole being drilled wherein the apparatus or "MWD Tool" can be commanded from the surface to make a measurement of desired parameters and transmit this information to the surface by encoding data in pressure pulses generated by a pulser valve that includes a stator and a rotor which may be open and closed to create pressure pulses.

1 Claim, 18 Drawing Sheets

MEASUREMENT WHILE DRILLING APPARATUS AND METHOD OF USING THE SAME

CROSS-REFERENCE TO RELATED APPLICATIONS

The present application is a continuation-in-part of U.S. patent application Ser. No. 13/906,588, filed May 31, 2013, currently pending, which is a continuation of U.S. patent application Ser. No. 13/417,695, filed Mar. 12, 2012, now U.S. Pat. No. 8,474,548, issued Jul. 2, 2013, which is a continuation-in-part of U.S. patent application Ser. No. 12/799,762 filed Apr. 30, 2010, now U.S. Pat. No. 8,251,160, issued Aug. 28, 2012, which is a continuation of U.S. patent application Ser. No. 11/518,648 filed Sep. 11, 2006, now U.S. Pat. No. 7,735,579, issued Jun. 15, 2010, which claims priority from U.S. Provisional Patent Application Ser. No. 60/716,268, filed on Sep. 12, 2005. The entire content of each of the above-referenced applications is hereby expressly incorporated herein by reference.

BACKGROUND OF INVENTION

1. Field of the Invention

In general, the present invention relates to a device, system and method of measuring angle and azimuth in subterranean drilling operations. More particularly, the present invention provides real time feedback during a drilling operation, referred to as "measurement while drilling", as to the angle and azimuth of the well bore during drilling operation typically associated with wells to indicate drift and direction from the desired drilling parameters by transmission of information from the bottom of a bore hole to the surface by encoding information in pressure pulses in the drilling mud. The invention further includes a system and apparatus for detecting and avoiding adjacent pipe and other obstacles while drilling.

2. Description of the Prior Art

In the drilling of deep bore holes for the exploration and extraction of crude oil and natural gas, the "rotary" drilling technique has become a commonly accepted practice. This technique involves using a drill string, which consists of numerous sections of hollow pipe connected together and to the bottom end of which a drilling bit is attached. By exerting axial forces onto the drilling bit face and by rotating the drill string from the surface, a reasonably smooth and circular bore hole is created. The rotation and compression of the drilling bit causes the formation being drilled to be successively crushed and pulverized. Drilling fluid, frequently referred to as "mud", is pumped down the hollow center of the drill string, through nozzles on the drilling bit and then back to the surface around the annulus of the drill string. This fluid circulation is used to transport the cuttings from the bottom of the bore hole to the surface where they are filtered out and the drilling fluid is re-circulated as desired. The flow of the drilling fluid, in addition to removing cuttings, provides other secondary functions such as cooling and lubricating the drilling bit cutting surfaces and exerts a hydrostatic pressure against the bore hole walls to help contain any entrapped gases that are encountered during the drilling process.

To enable the drilling fluid to travel through the hollow center of the drill string, the restrictive nozzles in the drilling bit and to have sufficient momentum to carry cuttings back to the surface, the fluid circulation system includes a pump or multiple pumps capable of sustaining sufficiently high pressures and flow rates, piping, valves and swivel joints to connect the piping to the rotating drill string.

Since the advent of drilling bore holes, the need to measure certain parameters at the bottom of the bore hole and provide this information to the driller has been recognized. These parameters include but are not limited to the temperature and pressure at the bottom of a bore well, the inclination or angle of the bore well, the direction or azimuth of the bore well, and various geophysical parameters that are of interest and value during the drilling process. The challenge of measuring these parameters in the hostile environment at the bottom of the bore well during the drilling process and somehow conveying this information to the surface in a timely fashion has led to the development of many devices and practices.

One method to gather information at the bottom of the bore well, frequently referred to as "surveying", is to stop the drilling process, disconnect the fluid circulation apparatus at the swivel joint and lower a measuring probe down the center of the hollow drill string to the desired depth using a cable and after making a measurement, by using mechanical timers or an electronic delay, pull the probe back out of the bore hole and retrieve the information at the surface before resuming the drilling process. This method has many clear and apparent disadvantages, such as the need to stop drilling for an extended period of time, the need to stop fluid circulation and bear the risk of having the drill string stuck in the hole or have the bore well collapse around the drill string. In addition, the need to make several successive closely spaced measurements cannot be met without spending an inordinate amount of time surveying and very little time actually spent drilling the bore well.

An improvement on this method is to have the measurement probe installed into the drill string and have it connected to a long continuous length of cable. This cable, which may have one or several conducting wires embedded in it, is run through the hollow center of the drill string to the surface. This cable can be used to provide power to and to transmit data from the probe back to the surface. Although this method allows for the ability to make successive and rapid measurement of the parameters of interest, it too has several disadvantages in that the cable also requires a swivel joint at the surface with the capability to feed electrical signals through it while maintaining a tight seal and contain high pressures all while being rotated. In addition, this method has the added disadvantage in that as extra lengths of drill string are added to drill deeper, the cable and attached probe will have to be removed from the drill string completely, the new length of drill string attached, and the cable and probe re-inserted into the bore well. As drill strings tend to be of roughly constant lengths of approximately 30 feet (10 meters), this method at best allows for surveying to be done uninterrupted for only this length.

There are obvious advantages to being able to send data from the bottom of the well to the surface while drilling without a mechanical connection or specifically using wires. This has resulted in tools often referred to as "measurement while drilling" or "MWD" for short which will be discussed in greater detail below. Types of MWD tools contemplated by the prior art have been such things as electromagnetic waves or EM (low frequency radio waves or signals, currents in the earth or magnetic fields), acoustic (akin to sonar through the mud or pipe and using mechanical vibrations) and pressure or mud pulse (sending pulses through the mud stream using a valve mechanism) which will also be discussed at greater lengths below.

U.S. Pat. No. 2,225,668, issued Dec. 24, 1940, is an example of an apparatus that proposes imparting electrical currents into the formation surrounding the bore well and inducing alternating currents that can be detected at the surface using widely spaced receivers. Even though this patent shows the measuring probe as being suspended in the bore hole using a cable, variants of this concept wherein the measuring probe is built into the drill string and the data is transmitted wirelessly using alternating currents in the earth have since been proposed and successfully used.

U.S. Pat. No. 2,364,957, issued Dec. 12, 1944, describes such a device wherein the measuring device is built into the drill string and the data is transmitted wirelessly to the surface using electrical signals in the formation.

U.S. Pat. No. 2,285,809, issued Jun. 9, 1942, is an example of an apparatus that proposes imparting mechanical vibrations onto the suspending cable used to lower the measuring probe into the well bore. These mechanical vibrations travel up the suspending cable and are detected at the surface and decoded.

As with the previous examples, this invention proposes that the measuring probe be suspended by a cable into the bore well. Variants of this concept have since been proposed wherein the sensing probe is built into the drill string and the vibrations are imparted onto the drill string itself.

U.S. Pat. No. 2,303,360, issued Dec. 1, 1942, describes such a device wherein the measuring device is built into the drill string and the data is transmitted wirelessly to the surface by imparting vibrations onto the drill string and earth, which are detected at the surface.

U.S. Pat. No. 2,388,141, issued Oct. 30, 1945, is another example of a device wherein the measuring device is built into the drill string and the data is transmitted wirelessly to the surface by imparting vibrations onto the drill string and earth, which are detected at the surface.

U.S. Pat. No. 3,252,225, issued May 24, 1966, is yet another example of a device wherein the measuring device is built into the drill string and the data is transmitted wirelessly to the surface by imparting vibrations onto the drill string that are detected at the surface.

Many more example of devices similar to these listed previously can be found in the literature, however further listing of these devices will be stopped as their practical usability in the drilling environment has been severely limited due to certain mitigating factors. In the case of devices that propose the usage of electrical or magnetic signals in the earth, the significant attenuation caused by the earth and certain types of formations limit the depth to which these devices can be successfully deployed. The ability to effectively deliver sufficient electromagnetic energy into the formation is limited by the available power sources and as such, the attenuation of the signals cannot be overcome with any degree of effectiveness.

Devices that impart vibrations onto the drill string and earth are limited by the attenuation of the signal due to the threaded connections between lengths of drill string and due to the inherent attenuation of the signal as it travels long distances along the drill string. In addition, these methods have proven unreliable to be used while drilling as the action of the drilling bit cutting the earth imparts vibrations onto the drill string, which overwhelm the signal being sent. These types of apparatus have been predominantly limited to surveying only when drilling is suspended.

In response to the many limitations of the previously described technologies and proposals, the use of pressure pulses to encode and send data to the surface of the earth has gained popularity and has remained the predominant method by which data is transmitted from the bottom of a well bore to the surface.

U.S. Pat. No. 1,854,208, issued Apr. 19, 1932, is an early example of a proposed apparatus that measures the angle of the well bore being drilled and as this measurement exceeds a predetermined threshold, closes a valve in the drill string so as to create a substantial pressure pulse that is detectable at the surface.

U.S. Pat. No. 1,930,832 issued Oct. 17, 1933, is another example of a proposed apparatus that measures the angle of the well bore being drilled and as this measurement exceeds a predetermined threshold, closes off the flow in the center of the drill string completely so as to create a substantial pressure increase that is detectable at the surface.

The apparatus listed above all rely on a purely mechanical action to create a flow restriction to create a pressure pulse. U.S. Pat. No. 1,963,090, issued Jun. 19, 1934, is an example of a proposed device that uses a battery power source and an electro mechanical sensing element to close a valve when the well bore deviation exceeds a threshold and to reopen it when the well bore threshold falls below the threshold.

U.S. Pat. No. 2,329,732 issued Sep. 21, 1943, is an example of a particularly successful concept wherein a purely mechanical device is used to measure the well bore inclination and transmit it to the surface using pressure pulses. Significantly improved variants of this proposed device are still being used in large numbers at the time of writing of this document. Devices of this nature vary the number of pulses that are sent to the surface depending on the well bore inclination measured. U.S. Pat. Nos. 2,435,934, 2,762,132, 3,176,407, 3,303,573, 3,431,654, 3,440,730, 3,457,654, 3,466,754, 3,466,755, 3,468,035 and 3,571,936 are a representative sample of the improvements and variations to this concept that have been proposed since its genesis. These variations include the ability to measure other parameters than well bore inclination and also include improvements that allow the usage of the time between the pressure pulse signals in addition to the total number of pressure pulse signals to encode information.

The devices listed above do have certain limitations in that they are non-reciprocating in nature. The measurements in these devices are made when the fluid flow is stopped for a short period of time and the data is transmitted only once when the fluid flow resumed. The advantage of having a downhole measurement while drilling device that can measure parameters whenever desired (not just when the fluid flow is interrupted) and transmit these parameters to the surface continuously or when desired, is readily apparent.

U.S. Pat. No. 2,700,131, issued Jan. 18, 1955, is an early example of a fully realized measurement while drilling tool wherein a pulsing mechanism (pulser) is coupled to a power source (in this case a turbine generator capable of extracting energy from the fluid flow) a sensor package capable of measuring information at the bottom of a well bore and a control mechanism that encodes the data and activates the pulser to transmit this data to the surface as pressure pulses. The pressure pulses are recorded at the surface by means of a pressure sensitive transducer and the data is decoded for display and use to the driller. U.S. Pat. Nos. 2,759,143 and 2,925,251 are other examples of such devices and detail fully realized MWD tools.

U.S. Pat. No. 3,065,416, issued Nov. 20, 1962, details a device where the main pulsing mechanism is open and closed indirectly by using a servo mechanism. This is an early representation of a mechanism that allows the fluid flow to do most of the work of opening and closing the valve and thus generating pulses. Other representative examples of servo driven pulser mechanisms have been proposed in U.S. Pat. Nos. 3,958,217, 5,333,686 and 6,016,288.

U.S. Pat. No. 4,351,037, issued Sep. 21, 1982, is an example of a variant to the pressure pulse generation mechanisms listed whereby a pulse is created not by creating a restriction to the flow if drilling fluid in the hollow center of the drill string, but by opening a closing a port on the side of the drill string. This methodology, often referred to as "a negative pulser", creates pressure decreases (as opposed to pressure increases) as venting fluid through a port in the dill string allows for some portion of the fluid to bypass the nozzles in the drilling bit.

U.S. Pat. No. 4,641,289, issued Feb. 3, 1987, is an example of a hybrid proposed pulsing mechanism whereby a positive pulser (one capable of creating positive pressure pulses) is coupled with a negative pulser (one capable of creating negative pulses) to provide the ability to create pressure pulses of various shapes and sizes by combining the action of both types of pulsers.

U.S. Pat. No. 4,847,815, issued Jul. 11, 1989, is an example of a "siren" type pulsing mechanism. This mechanism creates positive pulses of reasonable magnitude in rapid succession and in a continuous fashion (as opposed to creating single pulses on demand) so as to generate a hydraulic carrier wave. Data is transmitted to the surface by varying the frequency of the pulses being generated or by creating phase shifts in the carrier wave. Other examples of siren type pulsers are proposed in U.S. Pat. Nos. 3,309,656 and 3,792,429. Another known problem with this type of prior art is that configuration of the blades allows constant exposure to fluid flow and results in faster erosion due to the linear arrangement of the valve to fluid flow.

Currently in the industry, simple probe type devices generally fall under two categories. The first general category is slickline tools. When well bore measurements needed to be made, the drill pipe is pulled a few feet off bottom and the Kelly is disconnected. A probe is then connected to the slickline, usually a reel of solid stainless steel wire of approximately 0.1" diameter, on the rig floor and the probe is inserted through the I.D of the drill pipe until the probe is seated near the bottom of the pipe and typically a few feet above the bit. The probes usually have some form of a timer, traditionally a mechanical clock with a timer. When the timer expires, the measurement is made and the probe is pulled back out of the drill pipe and the recorded information is retrieved from inside the probe which may utilize a pendulum on a pivot and a paper disk. When the timer expires, a spring loaded pin fires and the angle of the well is punched onto the paper. Newer versions of such tools use digital processors, flash memory and batteries to enable multiple timed measurements and the ability to record various measurements. But the basic limitation is the need to lower and retrieve them from the bottom of the well through the drill pipe using the slick line.

The second general category is wireline tools. The next generation above the slickline tools, allow the transmission of data through a wireline. This is usually an insulated conductor line sheathed in steel and mounted onto a big truck. The wireline, which may be one or more conductors up to a reasonable number of 7 or 8 conductors, allows power to be sent down to the probe and the data transmitted up in real time. These tools are primarily used in open hole or cased hole applications where the drill pipe is not in the well bore and they are predominantly used to measure lithological data as needed between bit runs or before the well is completed for production. Some of these tools were then later modified to allow data to be gathered and sent up to the surface while drilling by inserting the tool through the drill pipe like slickline tools.

This involves the use of special slip ring connectors, high pressure packers to seal around the wire and other highly specialized equipment which allows the drill pipe to be rotated while the cable at the surface does not. A real limitation of these tools is that wireline comes in lengths thousands of feet long, typically mounted on a big truck, while drill pipe is generally 30 ft. long. So the tool probe has to either be removed from the Drill Pipe ID every joint or the wireline has to be built with disconnect points and splices. This is often very cumbersome and has other drawbacks that have been previously discussed.

Of these options, the first one to successfully achieve the goal of data telemetry to the surface without wires was mud pulse and therefore the MWD has become synonymous with mud pulse in the industry. The prior art did not, however, lead to viable products at industry wants. See U.S. Pat. Nos. 2,978,634 and 3,052,838. Its introduction and the continual development efforts of many competing parties eventually lead to the first electronic MWD tool in the late 70's. See U.S. Pat. Nos. 4,520,468 and 3,958,217. These tools measured parameters downhole using processors and batteries and transmitted them to the surface using a "mud pulser".

As generally discussed above, the primary and dominant piece of information that is essential in MWD is inclination or simply the angle of the bottom of the well. It is essentially impossible to drill a straight or vertical well bore. Therefore, periodic measurements of the angle of the bottom together with even a rough idea of the depth of the bit allows the plotting of a "worst case" deviation of the bottom of the well from the well head. This essentially requires straight forward trigonometry.

The term "worst case" is used because oil wells have a nature to spiral towards their target due to the cumulative effects of counter torque applied by the drill bit onto the formation. To pinpoint the location of the bottom of the well requires three things. The first is generally accurate depth usually referred to as MD for measured depth. The length of pipe is always longer that the actual vertical depth of the well because the hole is never straight and often curved and spiraled. Second is inclination and the third is azimuth. This provides the direction that the bottom of the well is pointing towards at periodic intervals which is generally measured at the same time as the inclination and almost always at the same depth.

With these three pieces of information, which are essentially 3D vectors distributed in space, a "curve" can be fit between them to draw a reasonable representation of the shape of the well bore being drilled and therefore "project" the location of the bottom of the hole relative to the well head. This has very clear implications to staying within lease limits, hitting the right target, and the overall success and profitability of the well itself. In addition, states require specific rules to be followed as far as surveying wellbores are concerned. For example, it is believed to be a requirement for a permitted straight hole in Texas to be within 6 degrees of vertical.

There are dozens if not hundreds of other parameters that can be measured, but most of those are pertinent to directionally drilling wells and logging wells. It is often considered that these types of wells represent a higher end market as opposed to straight hole applications. In more typical straight hole operations, it is still desirable to measure angle and azimuth and send the information to the surface. This when combined with the depth information that the rig already has, allows the curve and shape of the wellbore to be determined and more importantly, the location of the bottom of the well to be estimated.

Most MWD tools were developed for the higher end of the market. These have typically been used, primarily, to help in the drilling of directional wells. These markets require that in addition to inclination and azimuth, a third measurement "toolface" be sent to the surface. In general, toolface helps the driller orient the bottom hole assembly and therefore steer the well in the desired direction. In order to properly steer the well, toolface needs to be sent up continuously (three to four times a minute). Toolface needs to be sent up all the time. The other measurements, angle and azimuth, are usually made every 100 or more feet on demand. Since original MWD tools were built to serve this market, it restricted the development of the tools in the following way; more data at faster intervals means faster pulsers; faster pulsers usually mean more power consumption; this usually means longer tools for bigger batteries; and it also generally means mechanically flexible (flexible tools are typically better to steer with as they bend around curves).

It is understood that the environment of drilling leads to an unfriendly environment for downhole tools. It is not unusual for the bottom hole temperatures to be up to 150-175° C., well depths to be 15,000 feet to 25,000 ft on average, the associated pressure caused by the weight of mud column to be 20000 psi, high degrees of vibration caused by the typical close proximity to the bit cutting rock which may be within feet, and "slim hole" applications wherein drill pipe is relatively small diameter with maybe a couple of inches in diameter total to work with. Further, accuracy issues arise in these conditions such as directional drilling usually requires relatively precise sensor data to accurately steer the well. The sum of the previous typically means expensive operations.

Traditional MWD tools are expensive to build and expensive to operate. And most in the consuming industry who drill straight holes could not afford them in the early days. In addition, these tools were finicky and required constant monitoring and maintenance. All this leads to a situation where MWD are generally hard to build and operate in the first place and they are relegated to the higher end of the industry. This is the direction that most have pushed this technology in the last 30 years.

In the prior art, there are still numerous straight holes being drilled everywhere every day. The industry still needs to survey and today their options are generally slicklines that are time consuming and risky such as but not limited to the fact pipe tends to get stuck if operators do not circulate the fluid; wireline which are often impractical and almost as expensive as MWD; and full MWD which is expensive.

The field of measurement while drilling (MWD) is reasonably mature and there are numerous apparatus and devices that have been developed and used over the years to provide a variety of different measured parameters to the driller. As previously outlined, these range from the simplest measurement of the temperature at the bottom of the bore hole to fully integrated products that provide a full range of measurements including but not limited to inclination, azimuth, toolface (rotational orientation of the bottom hole assembly), pressures, temperatures, vibration levels, formation geophysical properties such as resistivity, porosity, permeability, density and insitu formation analysis for hydrocarbon content.

However, there are several limitations both in the capability and in the usability of the available products as has been generally discussed above. Due to the harsh nature of the downhole drilling environment, MWD tools necessarily have to be robust in design and execution. In addition, the constant flow of drilling fluid through or past the MWD tool causes significant erosion of exposed components and can cause significant damage to tools if improperly designed or operated.

It is understood that the term "drilling fluid" is used here to represent an extremely wide variety of water or oil based liquids of varying densities, viscosities and contaminant content. The need to keep the bore hole hydrostatic pressures high in order to contain or reduce the risk of a gas pocket from escaping the bore well results in the drilling fluid being weighted with additives to increase its density. These additives often tend to be abrasive in nature and further exasperate the erosion problems associated with the flow of the fluid past the tool.

In addition, the need to preserve and maintain the quality of the bore well and to prevent or reduce the risk of the bore well caving in, other filler materials are added to the drilling fluid to aid in bonding the bore well walls. These filler materials tend to be granular in nature and clog or cover inlet and outlet ports, screens and other associated hydraulic components that are part of most MWD tools.

Further, the extreme temperatures and pressures that are present in the bottom of the bore well often necessitate the use of expensive and exotic sealing mechanisms and materials, which increase the costs of operating the MWD tools, and thereby reduce their usability to the wider market place.

Still furthermore, due to the high costs associated with drilling oil and gas bore holes, any time that is spent repairing, maintaining or servicing failed or non-functional equipment results in a severe reduction in the productivity of the whole drilling operation. As such, MWD tools have always needed to be designed, built and operated with a need for high quality and reliability.

All these and other factors not listed combine to make the design, manufacture and use of MWD tool an expensive prospect for the industry and therefore result in high costs for the customer, the driller. These high costs tend to make MWD tools unavailable or unaffordable to the majority of the drilling market. Although MWD tools that are capable of providing sufficient information to the driller in a reasonably effective manner have been limited to the higher end drilling operations, usually those involving drilling in high cost environments (such as offshore drilling platforms) or in specific limited markets (such as directionally drilling well bores), a large portion of the drilling market is predominantly involved in the drilling of straight vertical well bores at relatively low costs and as such, do not have access to a simple, reliable MWD tool that can provide them with the minimum of information that they may require to effectively drill these bore holes.

Thus, there is a need for a product that fills the needs of the industry. It is desirable to fill these needs at rates that are affordable and attractive to the majority of straight hole rigs while providing more information than the prior art. The above discussed limitations in the prior art is not exhaustive. The current invention provides an inexpensive, time saving, more reliable apparatus and method of using the same where the prior art fails.

SUMMARY OF THE INVENTION

In view of the foregoing disadvantages inherent in the known types of equipment and methods of use now present in the prior art, the present invention provides a new and improved apparatus, system, and method of use which may allow for feedback for drilling operations. As such, the general purpose of the present invention, which will be described subsequently in greater detail, is to provide a new and improved drilling feedback apparatus and method of using the same which has all the advantages of the prior art devices and none of the disadvantages.

It is therefore contemplated that the present invention is a method and apparatus used to transmit information to the surface from a subsurface location during the process of drilling a bore hole. A novel pressure pulse generator or "pulser" is coupled to a sensor package, a controller and a battery power source all of which reside inside a short section of drill pipe close to the bit at the bottom of the bore hole being drilled. The assembled apparatus or "MWD Tool" can be commanded from the surface to make a measurement of desired parameters and transmit this information to the surface. Upon receiving the command to transmit information, the downhole controller gathers pertinent data from the sensor package and transmits this information to the surface by encoding data in pressure pulses. These pressure pulses travel up the fluid column inside the drill pipe and are detected at the surface by a pressure sensitive transducer coupled to a computer which decodes and displays the transmitted data. The pulser includes a stator with inlet passages that are orthogonal to the direction of fluid flow inside the drill pipe and a plurality of circular holes that are in line with the direction of fluid flow. Drilling fluid that is pumped from the surface down the drill pipe, flows through these holes in the stator on its way towards the bit. The pulser also includes a rotor which resides inside the stator body and has cylindrical blade surfaces which in a first orientation allows fluid to flow unobstructed through the slots orthogonal to fluid flow. In a second orientation, the rotor is rotated and the blades are used to create an obstruction in the path of fluid flow through the orthogonal slots and thus generate a pressure pulse detectable at the surface. The rotor is connected by a shaft to a geared electric motor drive which is used to rotate the rotor between these two orientations. The geared electric motor drive resides in a sealed air filled environment and is protected from the drilling fluid by a high pressure seal on the shaft and rolling element bearings to support axial and radial loads. The controller is used to generate pressure pulses with various desired characteristics by varying the rotation and oscillation of the rotor inside the stator. The MWD tool also has a novel power activation switch that allows the tool to be powered upon insertion into the borehole.

The present invention essentially comprises a system and method for determining the location of drilling. To attain this, the present invention may comprise a pulser valve assembly, a sensor package assembly, a power source assembly, a pressure switch assembly, and a computer assembly to detect the signals and display it to the user. It is further contemplated that the invention may include more than just oil field operations and may be used in numerous subterranean applications where location of operations is desired.

The present invention may comprise a tool that is inserted into a short length of drill string and is situated a short distance above the drilling bit in the bottom-hole assembly of the drill string. The invention may include an electrical power source, such as a battery pack. This electrical power source may also include a fuel gauge that is used to monitor the energy consumption and can give an indication as to the remaining power capacity of the power source. The invention may also include a mechanical hydrostatic pressure switch that is used to activate the tool when the tool is inserted in to the bore hole and vice versa, de activate the tool when it is removed from the bore hole.

The invention may further include a sensor package that is capable of measuring various parameters of interest at the bottom of the bore hole. In one preferred embodiment, the sensor package is capable of measuring the inclination of the bore hole relative to the vertical using sensors and transducers sensitive to the earth's gravity field. In another embodiment, the sensor package is capable of measuring the inclination of the bore hole relative to vertical using sensors and transducers sensitive to the earth's gravity field and is also capable of measuring the direction (azimuth) of the bottom of the bore hole by using sensors and transducers sensitive to the earth's magnetic field.

Furthermore, the invention may include a controller that gathers data from the sensor package and uses it to generate pressure pulses that are transmitted to the surface in an encoded format that are detected and decoded at the surface. The controller may be powered by the previously described electrical power source and comprises of the necessary power supplies to regulate and deliver the proper voltage levels to the sensor package. The controller may also include a processor that is capable of gathering data from the sensor package and convert thus gathered data into signals that are used to command and control the pulser mechanism to generate the pressure pulses.

In addition, the controller preferably includes a vibration sensitive switch that is responsive to the small amount of vibration caused by the flow around the tool, and more importantly, may detect the absence of vibration caused by the absence of fluid flow around the tool. The command to initiate transmission of data may be sent from the surface to the tool in the bore hole by stopping the fluid circulation for a predetermined amount of time. The vibration sensitive switch in the tool may detect the absence of vibration, gather data from the sensor package, and converts it into an encoded format and readies it for transmission. When the predetermined time expires, fluid flow is resumed and the vibration sensitive switch detects the vibration caused by the flow past the tool. The controller may then begin transmitting the data to the surface by commanding the pulser to generate pressure pulses in accordance with the telemetry format applicable to the data.

The invention may include a pressure pulse generating mechanism or pulser that is powered by the electrical power source and whose operation is directed by the controller. The pulser may comprise a cylindrical stator assembly with inlet slots orthogonal to the direction of fluid flow and a plurality of circular holes in line with the direction of fluid flow. The pulser may include a rotor assembly that resides inside the stator and consists of a cylindrical body with slots that match the inverse of the inlet slots in the stator. These slots in the rotor may be blade like in shape and reside in a primary orientation with the inlet slots in the stator which may be in line with the slots in the rotor. In this orientation, the pulser is considered to be in the open position and as such does not project any significant resistance to the flow of fluid through the stator and rotor. In a second orientation, the rotor is rotated through a predetermined angle so as to line up with inlet slots in the stator with the blade surface of the rotor. In this second orientation, the pulser may be considered to be in a closed position as the rotor and stator combine to provide a significant restriction to the flow of fluid through the tool. In either the first or second orientation, the circular holes that lie inline with the fluid flow may not be affected.

The act of rotating the rotor to close the pulser causes a significant restriction in the flow path, which may manifest itself as an increase in the pressure required to force the fluid through these, now smaller, and more restrictive flow paths.

By consecutively oscillating the rotor between the first and second orientations, the pulser may be cycled between the open and closed position. Each single oscillation may generate a discrete pressure pulse whose width is a function of the time taken to open and then close the pulser. By varying the speed of closure and opening of the valve, and by leaving the valve in open or closed position for different lengths of time, pulses of varying widths and shapes may be generated.

In a preferred embodiment, the rotor of the pulser is attached to a shaft assembly which may comprise of rolling element thrust and radial ball bearings to support the shaft and rotor assembly against the loads and forces acting on it due to gravity and the pressure differentials caused by steady fluid flow and the act of creating pressure pulses. In addition, the shaft assembly may have a dynamic elastomeric seal, which could be used to provide a barrier between the high pressure fluid filled environment of the bore hole and the air filled, un-pressurized internal section of the tool. This dynamic seal may protect from the contaminants and particulates found in the drilling fluid flow by a suitable wiper assembly that is designed to be incapable of sealing pressure, but capable of effectively straining the drilling fluid of all contaminants that might cause damage to the dynamic seal.

The shaft assembly may be connected to a geared electric motor drive through a suitable coupling device that is capable of transmitting torque but may be incapable of transmitting axial loads onto the shaft of the gearbox. This coupling device may be designed to accommodate a mechanism to provide stopping end points for the rotation of the shaft assembly. These stops may be aligned with the inlet slots in the stator so that if the stop is engaged at one extreme, the rotor is placed in its open position and if the stop is engaged in the second extreme, the rotor is placed in its closed position. Thus, the act of opening and closing the rotor assembly may be converted to the action of driving the geared electric motor drive between these two stops.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved drilling feedback apparatus and method of using the same that will alleviate if not solve some if not all of the problems and limitations expressed thus far and allow for an apparatus that will be capable of operating in a majority of the environments commonly encountered during the drilling process.

Furthermore, an object of the present invention to provide a new and improved drilling feedback apparatus and method of using the same which is robust and still may be easily and efficiently manufactured and marketed.

Another object of the present invention is to provide a new and improved drilling feedback apparatus and method of using the same that has a very simple user interface and as such requires minimal training and time to operate. This may reduce the need for trained personnel to be present at all times.

It is a further object of the present invention to provide a new and improved drilling feedback apparatus and method of using the same which is of a durable and reliable construction and may be utilized in any subterranean application and depth. It is further contemplated that the invention may be used in off-shore applications and generally below water where location detection may be desired.

An even further object of the present invention is to provide a new and improved drilling feedback apparatus and method of using the same which is susceptible to a low cost of manufacture with regard to both materials and labor, and which accordingly is then susceptible to low prices of sale to the consuming industry, thereby making such tool economically available to those in the field.

Still another object of the present invention is to provide a new and improved drilling feedback apparatus and method of using the same which provides all of the advantages of the prior art, while simultaneously overcoming some of the disadvantages normally associated therewith.

Another object of the present invention is to provide a new and improved drilling feedback apparatus and method of using the same which may be used interchangeably in all types of wells with various construction.

Yet another object of the present invention is to provide a new and improved drilling feedback apparatus and method of using the same which provides for real time drilling feedback and thus reduces the amount of time needed for drilling corrections.

An even further object of the present invention is to provide a new and improved drilling feedback apparatus and method of using the same in straight hole wells in an economic manner and still provides angle, azimuth, and better quality data.

Still another object of the present invention is to provide a new and improved drilling feedback apparatus and method of using the same provides the consuming industry with an affordable option that provides necessary feedback in drilling operations.

A further object of the present invention is to provide a new and improved drilling feedback apparatus and method of using the same which eliminates the need for small passage ways and filtering mechanisms that can be obstructed by contaminants and additives in the drilling fluid. In addition, the present invention may provide a reasonably small cross section and does not significantly impede the flow of drilling fluid on its way to the bit during normal drilling operations and thus will significantly reduce erosion and wear that is caused to MWD tools due to the high flow velocities of the drilling mud.

An even further object of the present invention is to provide a new and improved drilling feedback apparatus and method of using the same which is exceedingly shorter than the prior art Measurement While Drilling systems. This short length may allow the tool to be built much stiffer and without the need for special flexible members to allow for the curvature of the bore hole. This added stiffness also permits the MWD tool to have greater resilience in the presence of high vibration and shock levels that are found in the bottom of a bore hole while drilling.

Still another object of the present invention is to provide a new and improved drilling feedback apparatus and method of using the same which provides a mechanism to adequately shock isolate the internal components of the MWD tool, especially the controller and sensor package assembly and the battery or power assemblies. This shock isolation mechanism is analogous to an electrical low pass filter for a mechanical system in that it attenuates high frequency shock pulses from being transmitted from the drill string through the container of the tool into the sensitive electronic components inside the tool.

Yet another object of the present invention is to provide a new and improved drilling feedback apparatus and method of using the same which provides a Measurement While Drilling System capable of generating pressure pulses of various amplitudes, shapes and sizes and to generate pressure pulses with sufficient clarity so as to enable their easy detection at the surface. This is combined with a telemetry format that utilizes pulse position encoding so as to enable the data being transmitted to be uniquely identified and decoded from the background electrical and pump signature noise that is present in the pressure waveforms of a drilling fluid circulation system.

Still another object of the present invention is to provide a new and improved drilling feedback apparatus and method of using the same that provides a robust interface at the surface which the driller can view, access and use the data being transmitted from the bottom of bore hole. The present invention utilizes analog electrical and software digital filtering and detection mechanisms to allow the survey to be effectively detected from the back ground pump pressure. In addition, the present invention details a mechanism whereby the data recovered from the downhole tool is stored and sorted into discrete subsets for the generation of survey reports and hard copy prints.

Another object of the present invention is to provide a new and improved drilling feedback apparatus and method of using the same that provides for a mechanism to activate the measurement while drilling tool in a simple manner so as to only have it powered when inserted into the bore hole. The present invention may detail a piston and spring mechanism that utilizes the hydrostatic pressure found in the well bore below a certain depth to engage a connector into the tool thus energizing the controller, sensor package and pulser. This mechanism may allow the tool to be provided to the drilling operation in an assembled form ready to use and conserves battery power when not in use.

It is also an object of the present invention to provide a new and improved drilling feedback apparatus and method of using the same that provides the benefit of using an orthogonally oriented fluid pulse system over the prior art in line flow pulse systems thus allowing for larger, wider, and longer openings in the valve. This orientation also allows the blades of the valve to be protected from constant contact with the flow from the fluid, and hence, decreases erosion and wear for a longer life span of the valve.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF DRAWINGS

The invention will be better understood and objects other than those set forth above will become apparent when consideration is given to the following detailed description thereof. Such description makes reference to the illustrations, graphs, drawings, and so forth.

FIG. 14B details the orientation of the stop dowel pin when the rotor is generally in the open position. FIG. 14C details the orientation of the stop dowel pin when the rotor is generally in the closed position.

DETAILED DESCRIPTION OF INVENTION

Figure 1:
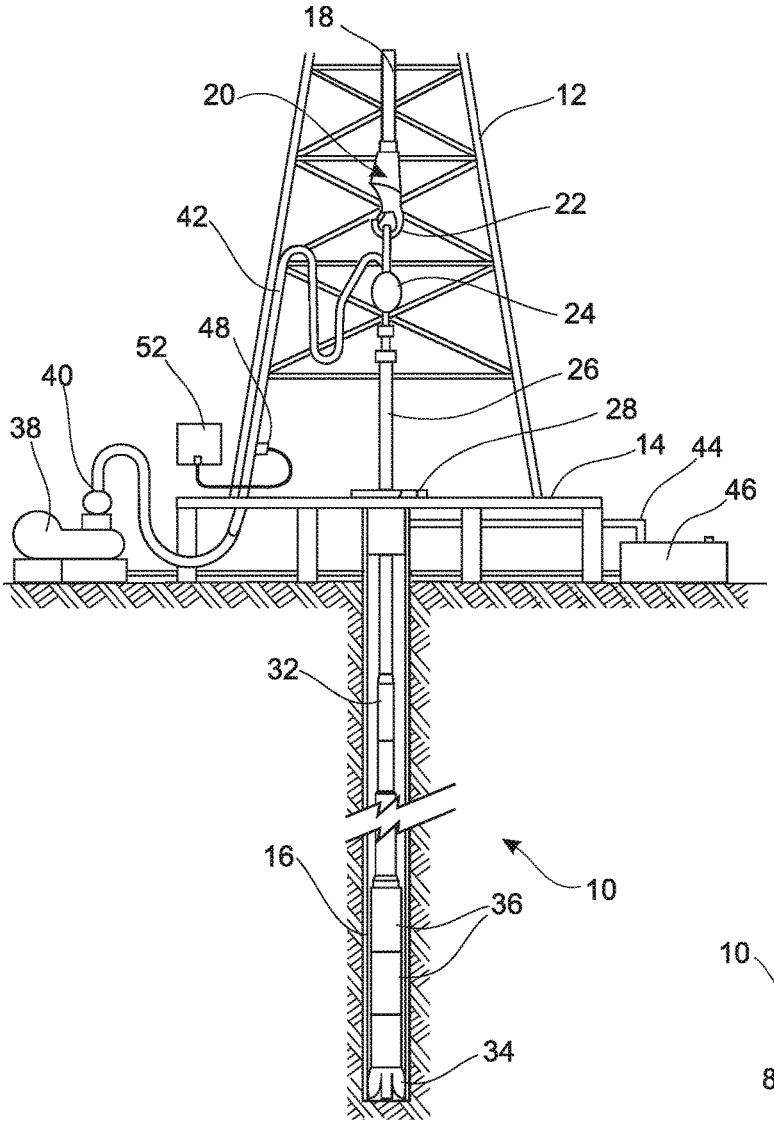
FIG. 1 is a representative sketch of a surface and downhole portions of a drilling apparatus that is commonly used to drill vertical bore wells.

In a preferred embodiment of the invention, as described in detail below, information of use to the driller is measured at the bottom of a bore hole relatively close to the drilling bit and this information is transmitted to the surface using pressure pulses in the fluid circulation loop. The command to initiate the transmission of data is sent by stopping fluid circulation and allowing the drill string to remain still for a minimum period of time. Upon detection of this command, the downhole tool measures at least one downhole condition, usually an analog signal, and this signal is processed by the downhole tool and readied for transmission to the surface. When the fluid circulation is restarted, the downhole tool waits a predetermined amount of time to allow the fluid flow to stabilize and then begins transmission of the information by repeatedly closing and then opening the pulser valve to generate pressure pulses in the fluid circulation loop. The sequence of pulses sent is encoded into a format that allows the information to be decoded at the surface and the embedded information extracted and displayed.

Although the term or terms "measurement while drilling", and "MWD", and "tool" are generally used synonymously with the reference numeral 10, this should not be considered to limit the invention to such. It is understood that the invention may be more than just a tool and the term invention may be inclusive of the apparatus, method of use, system and so forth. For purposes of convenience, the reference numeral 10 may generally be utilized for the indication of the invention, portion of the invention, preferred embodiments of the invention and so on.

Referring now to the drawings and specifically to FIG. 1, there is generally shown therein a simplified sketch of the apparatus used in the rotary drilling of bore holes 16. Bore hole 16 is drilled into the earth using a rotary drilling rig which consists of a derrick 12, drill floor 14, draw works 18, traveling block 20, hook 22, swivel joint 24, kelly joint 26 and rotary table 28. A drill string 32 used to drill the bore well is made up of multiple sections of drill pipe that are secured to the bottom of the kelly joint 26 at the surface and the rotary table 28 is used to rotate the entire drill string 32 assembly while the draw works 18 is used to lower the drill string 32 into the bore hole 16 and apply controlled axial compressive loads. The bottom of the drill string 32 is attached to multiple drilling collars 36, which are used to stiffen the bottom of the drill string 32 and add localized weight to aid in the drilling process. A measurement while drilling (MWD) tool 10 is generally depicted attached to the bottom of the drill collars 36 and a drilling bit 34 is attached to the bottom of the MWD tool 10.

The drilling fluid is usually stored in mud pits or mud tanks 46, and is sucked up by a mud pump 38, which then forces the drilling fluid to flow through a surge suppressor 40, then through a kelly hose 42, and through the swivel joint 24 and into the top of the drill string 32. The drill fluid flows through the drill string 32, through the drill collars 36, through the MWD tool 10 housing or drill collar 36, through the drilling bit 34 and its drilling nozzles (not shown). The drilling fluid then returns to the surface by traveling through the annular space between the outer diameter of the drill string 32 and the bore well. When the drilling fluid reaches the surface, it is diverted through a mud return line 44 back to the mud tanks 46.

The pressure required to keep the drilling fluid in circulation is measured by a pressure sensitive transducer 48 on the kelly hose 42. The measured pressure is transmitted as electrical signals through transducer cable 50 to a surface computer 52 which decoded and displays the transmitted information to the driller.

In some drilling operations, a hydraulic turbine (not shown) of a positive displacement type may be inserted between the MWD tool 10 drill collar 36 and the drilling bit 34 to enhance the rotation of the bit 34 as desired. In addition, various other drilling tools such as stabilizers, one way valves and mechanical shock devices (commonly referred to as jars) may also be inserted in the bottom section of the drill string 32 either below or above the MWD tool 10.

Figure 2:
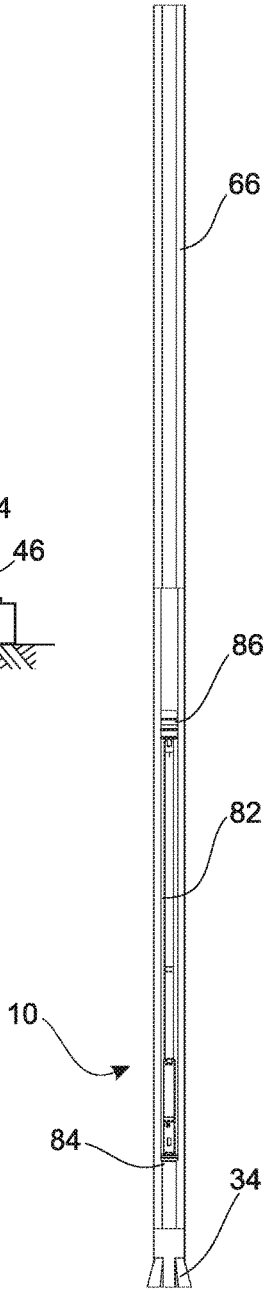
FIG. 2 is a representative sketch of a lower extremity of the downhole portion of a drilling apparatus that generally indicates the Measurement While Drilling tool and its possible placement in the drill string.

FIG. 2 generally shows a somewhat more detailed view of the bottom section of the drill string 32 and details the drilling bit 34, the MWD tool 10 is carried inside a short section of the MWD tool 10 drill collar 36 and the lowest section of drill collar 66. This lowest section of drill collar 66 may be non-magnetic in nature to aid in the proper measurement of certain downhole parameters, especially those related to the measurement of direction (azimuth). The MWD tool 10 is supported inside the MWD tool 10 drill collar 36 by two centralizing rings 84 and 86 that are near the bottom and top of the MWD tool 10 respectively.

Figure 3:
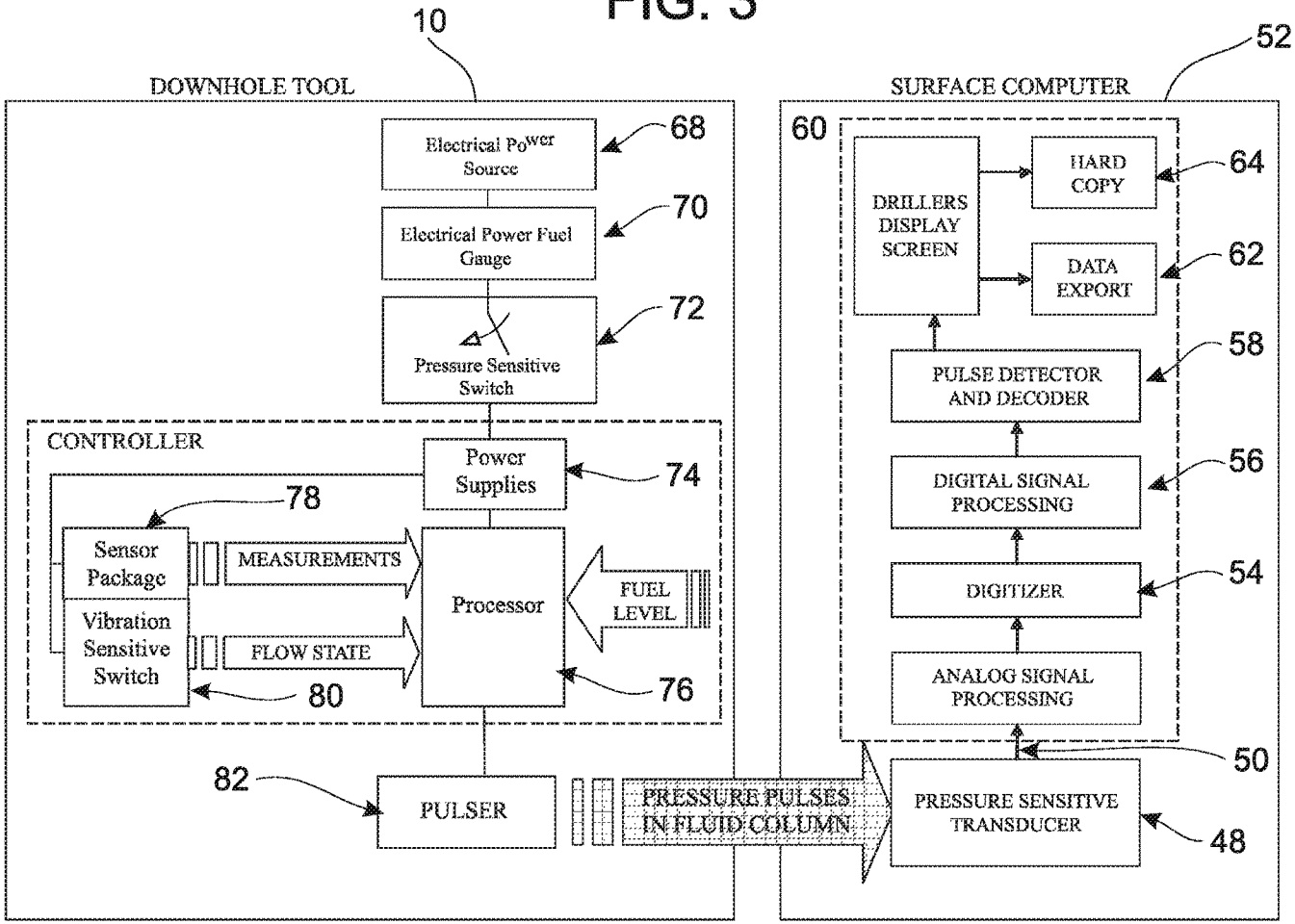
FIG. 3 is a representative sketch of the various components that together may comprise the MWD tool.

FIG. 3 generally shows a schematic representation of the various components that together make up the present invention. The downhole MWD tool 10 consists of an electrical power source 68 coupled to an electrical power fuel gauge 70. The electrical power source 68 and gauge 70 are connected to a pressure sensitive switch 72 which is engaged when the MWD tool 10 is inserted into the bore well a certain depth. Power supplies 74 in the downhole MWD tool 10 convert the electrical power into the required form and provide this power to a sensor package 78, vibration sensitive flow switch 80 and a processor 76. The processor 76 has the ability to gather data from the electrical power fuel gauge 70 about the status of the remaining power capacity. The processor 76 can also gather data from the vibration sensitive flow switch 80 and the sensor package 78. By looking at the flow state, the processor 76 can determine when to acquire data from the sensor package 78 and the fuel gauge 70. Upon gathering this information and when the flow state indicates that the data is ready to be transmitted, the processor 76 can command a pulser valve 82 to transmit encoded data to the surface via pressure pulses in the fluid column.

The pressure sensitive transducer 48 is used to measure these pressure pulses at the surface and convert them into analog electrical signals, which are carried by transducer cable 50 to the surface computer 52. Upon entering the surface computer 52, these analog electrical signals are passed through an analog signal processing block, which is used to filter the electrical signals to remove unwanted or unnecessary signatures in the data. The filtered analog data is then converted into a digital form with the use of a digitizer 54. The digitized data if then further filtered using a digital signal processor 56 to further remove unwanted signatures and refine the shape, amplitude and clarity of the pressure pulses. This filtered data stream is then passed through a pulse detection and decoding module 58 which locates individual pressure pulses and using a reverse of the encoding format used by the downhole MWD tool 10, recovers the embedded data. The recovered data is then displayed, either sorted by depth or time to the driller using a drillers display screen 60. The surface computer 52 also stores the recovered data and this data can be printed out as a hard copy using a hard copy printer 64. The data can also be exported or saved off using a data export device 62.

As previously stated, the MWD tool 10 is carried inside a short section of drill collar 36. This short section of drill collar 36 may be bored out to provide adequate room for the MWD tool 10 to be placed inside and still allow sufficient room for the drilling fluid to pass by without significant restriction. This short section of drill collar 36 may also be non-magnetic in nature similar to the drill collar section 66 above it so as to enable the proper measurement of certain downhole parameters. In addition, this short drill collar 36 may also have sensors built into it which are used to measure other desired parameters. These parameters are then measured by the downhole MWD tool 10 as needed through suitable connectors, wires or through the use of wireless radio signals.

Figure 4:
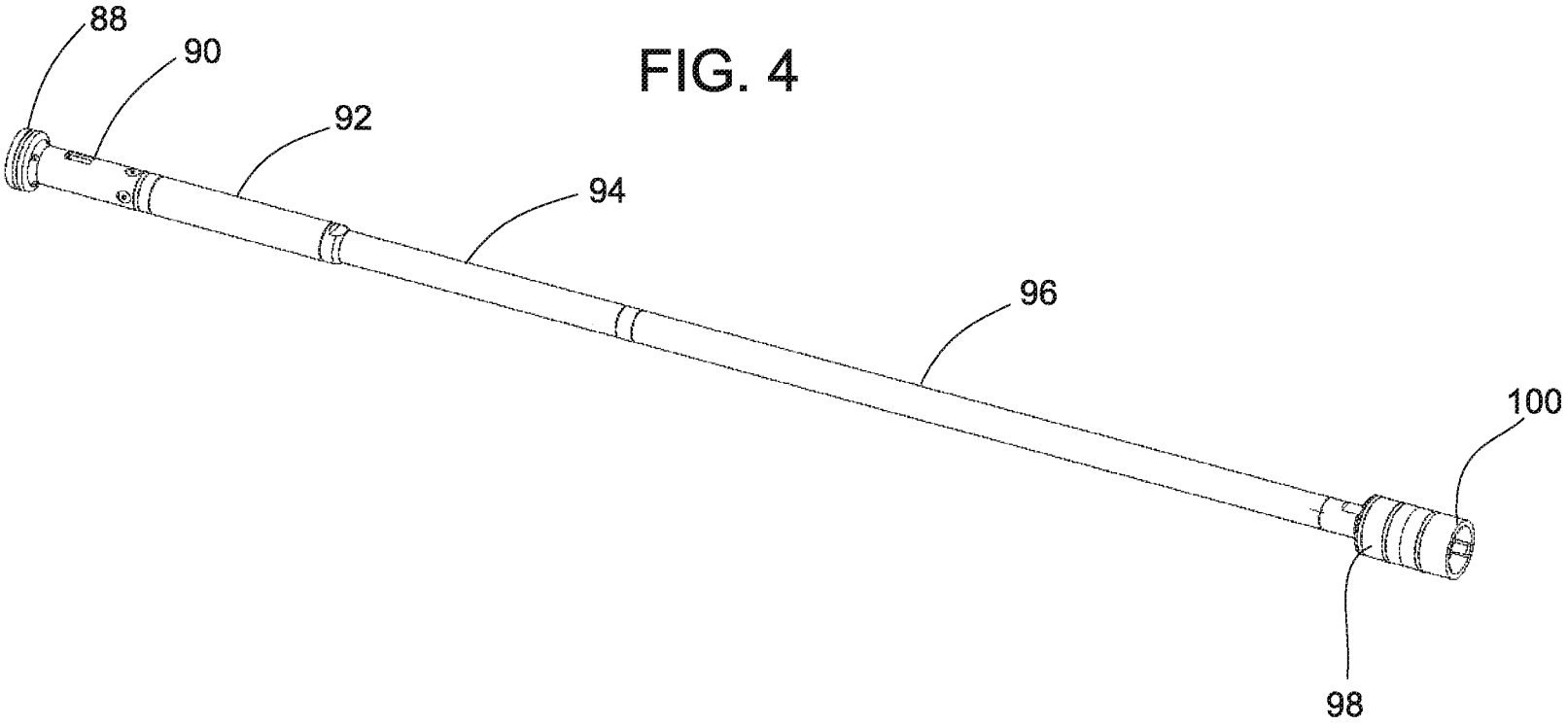
FIG. 4 is a three dimensional view of one possible embodiment of the MWD tool generally shown before insertion into the drill string.

FIG. 4 generally shows a three-dimensional view of the MWD tool 10 in the present embodiment shown in its assembled form prior to insertion into the drill collar 36. The outer sections of the MWD tool 10 in its mechanical form comprises of a debris catching mechanism 100 that sits on top of the assembled tool 10. This debris catching mechanism 100 is used to restrict the ability of extremely large contaminants such as large rocks, large pieces of metal or debris from the pump 38, from being pumped down to the valve section of the MWD tool 10. In addition, this debris catching mechanism 100 incorporates a landing ring to allow wireline conveyed tools to seat on top of the MWD tool 10 in the event that such tools are needed to make measurements of downhole parameters in lieu or in addition to the measurement sent by the MWD tool 10.

The MWD tool 10 also includes an upper centralizer 98 that is used to retain the MWD tool 10 in the center of the drill collar 36. In addition, it also houses the pressure sensitive switch assembly 72 described in detail later with the aid of FIGS. 6 and 7. The MWD tool 10 also consists of an electrical power source subassembly 96 which contains the electrical power source 68, fuel gauge 70 and the mating components to the pressure sensitive switch assembly 72.

The MWD tool 10 also consists of an electronics assembly 94 which contains within it the power supplies 74, processor 76, sensor package 78 and the vibration sensitive switch 80. In addition, it also contains the electrical circuitry required to properly actuate the pulser or pulser valve 82. The electronics assembly 94 and the electrical power source subassembly 96 both incorporate vibration isolation mechanisms that allow them to operate in the hostile drilling environment. These vibration isolation mechanisms are described in further detail later with the aid of FIGS. 8, 9, 10 and 11.

Figure 13:
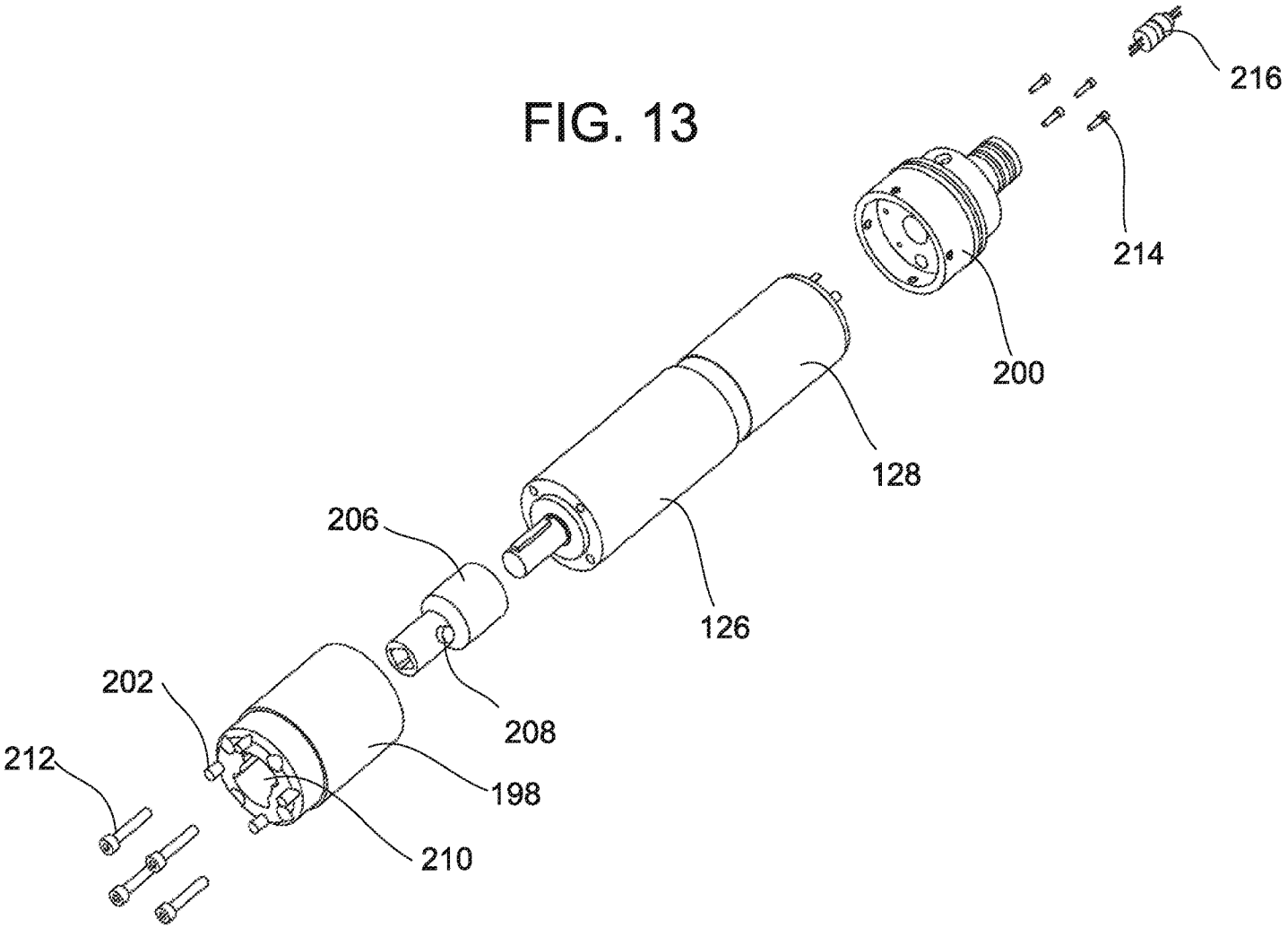
FIG. 13 is an exploded three dimensional view of a geared electric motor drive.

The MWD tool 10 also consists of a pulser drive subassembly 92 which houses the geared electric motor drive mechanism as generally shown in FIG. 13 and the associated linkages that allow it to be connected to the pulser valve 82. In addition, the MWD tool 10 also consists of a stator assembly or stator 90 which is attached to the pulser drive subassembly 92. This stator 90 also incorporates a lower centralizer 88 which is used to orient and retain the MWD tool 10 in the center of drill collar 36.

The circulating fluid travels down the drill string 32 and passes through the debris catching mechanism 100 and through the upper centralizer 98. At this location, the fluid flow diverted to flow in an annular fashion between the outside of the electrical power source subassembly 96 (and the electronics assembly 94 and the pulser drive subassembly 92) and the inside of drill collar 36. The circulating fluid then is re-diverted as it flows through openings 102 and 106 that are part of the stator 90. In this fashion, the circulating fluid flows past and through the MWD tool 10 on its way to the drilling bit 34 without any significant obstruction to its flow.

The pressure pulse described above is generated when the openings 102 in the stator 90 assembly are obstructed (or closed) by the action of the pulser drive subassembly 92 mechanism and its attached rotor 104. Due to the reduction in available flow paths and areas, the pressure required to pump the circulating fluid through the MWD tool 10 increases thus resulting in a measurable pressure increase at the surface. By alternating the opening and closing of the stator 90 openings 102, these pressure increases and decreases take the form of a pressure pulse that is detected at the surface.

Figures 5A, 5B, 5C:
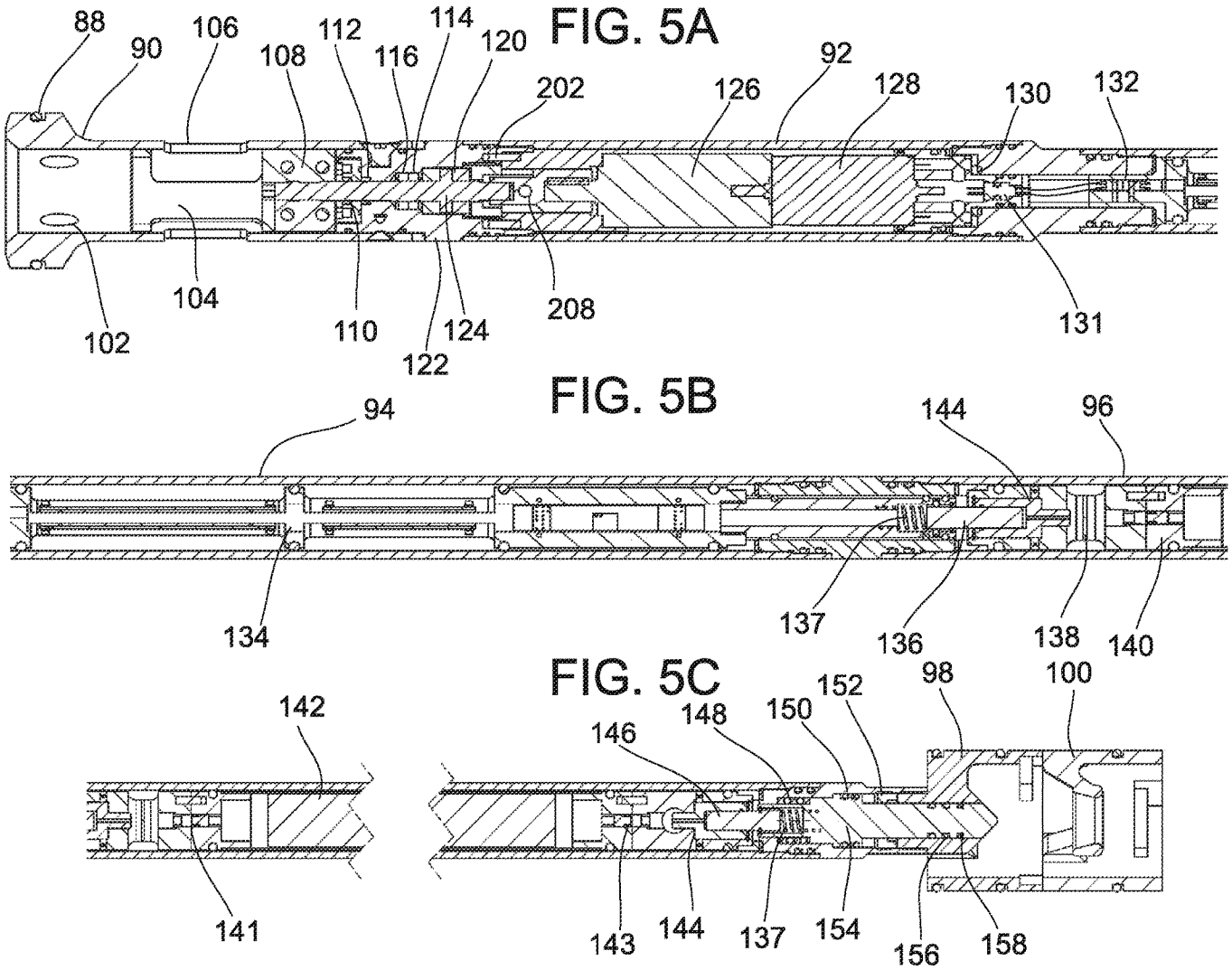
FIGS. 5A through 5C are two dimensional cross section views of the MWD tool generally shown in FIG. 4.

FIGS. 5A, 5B and 5C generally show a cross-sectional view of a MWD tool 10 in accordance with a preferred embodiment of the invention. In order to further explain the components and for purposes of convenience, the following will describe the individual sections of the tool 10 shown in FIGS. 6 through 19 in that order while referring back to FIGS. 5A, 5B and 5C as needed.

Figure 6:
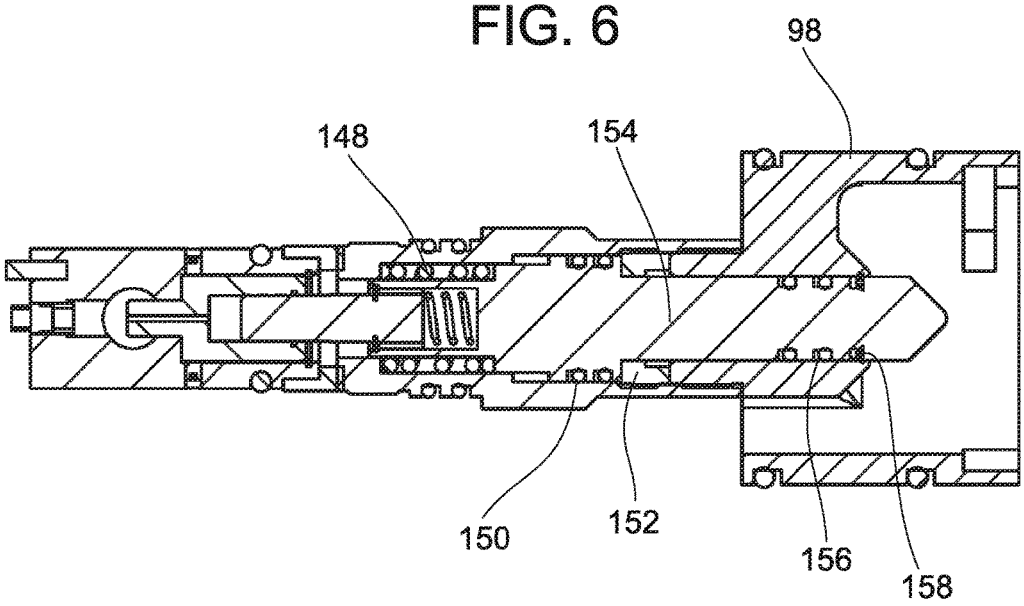
FIG. 6 is a view of a pressure sensitive switch in its open position as it may be when not inserted into the bore hole.

FIG. 6 generally shows a cross-sectional view of the top of the MWD tool 10 including the upper section of the electrical power source subassembly 96 and the whole of the pressure sensitive switch assembly 72. The upper centralizer 98 contains within it a piston 154 that is held in pre-compression by spring 148. The piston 154 has two sets of o-ring seals 150 and 156 together with an elastomeric wiper 158. These seals 150 and 156 and wiper 158 allow the piston 154 to maintain a sealed low pressure atmosphere inside the MWD tool 10 when exposed to the pressures and fluid at the bottom of a well bore while at the same time allow the piston 154 to slide down freely. The piston 154 is held inside the upper centralizer using a piston retention nut 152. In the view shown in FIG. 6, the piston 154 is in its upper or open position as it normally would be at the surface or when no pressure is being applied to the MWD tool 10.

Figure 7:
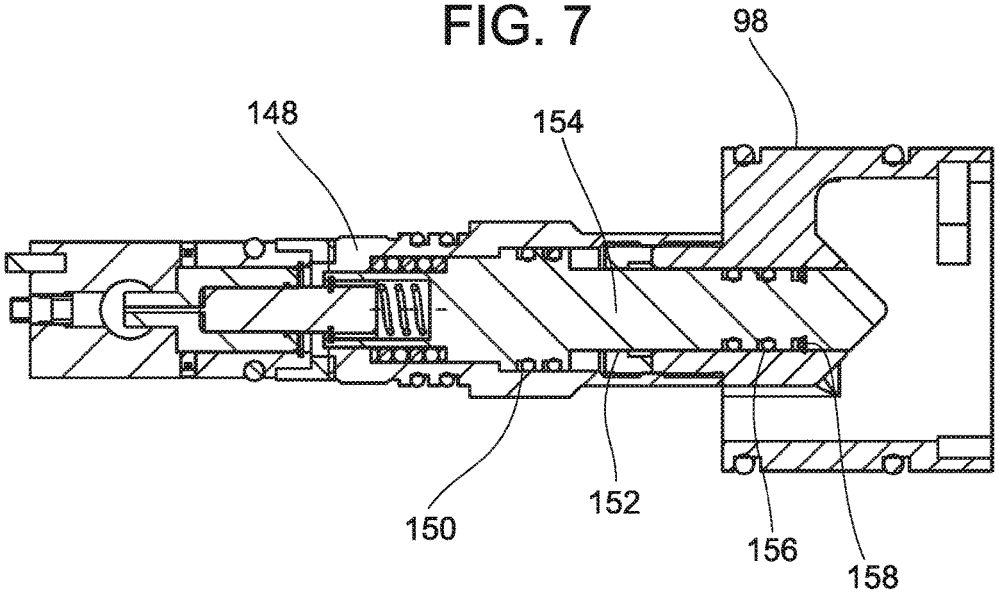
FIG. 7 is a view of the pressure sensitive switch in its generally closed position as it may be when inserted at a certain depth into the bore hole.

FIG. 7 generally shows the same components as FIG. 6 but is shown as it would be if the tool 10 has been exposed to pressures inside a bore hole. Note that in this diagram, the piston 154 is shown in its lower or closed position. As the inside of the MWD tool 10 is sealed, it contains ambient pressure air that was trapped inside at the time of its assembly. When the MWD tool 10 is inserted into the bore hole, the hydrostatic pressure of the drill fluid caused a high pressure to be seen on the outside and top surfaces of the piston 154. This high pressure is retained by the seals 150 and 156 and as such a differential force is created upon the piston 154. This differential force increases with depth and slowly beings to overcome the pre-compression of the spring 148 until the pressure force reaches equilibrium with the pre-compressive force of the spring 148, and beyond this depth the piston 154 begins to move downward. As the depth increases, the piston 154 moves downward until its motion is stopped by hitting the piston housing.

When the piston 154 is in the open position, connectors 144 and 146, see FIG. 5C, are disengaged and as such no power is sent to the electronics assembly 94 or pulser drive subassembly 92. When the piston 154 is in its closed position, the male connector 144 is firmly seated inside the female connector 146 and in this fashion, the electrical circuit is completed and the MWD tool 10 is powered on. When the MWD tool 10 is removed from the bore hole, this process reverses and the piston 154 disengages the male connector 144 from the female connector 146 and the MWD tool 10 is un-powered. In this fashion, the act of inserting the MWD tool 10 into the bore hole is utilized to turn the MWD tool 10 on so as to conserve power and provide a reliable means of activating the tool that requires no human intervention.

The male connector 144 that is part of piston 154 is held in pre-compression by spring 148 so as to prevent over engagement of the connectors 144 and 146 as the piston 154 travels downward. In the present embodiment, as the piston 154 travels downward as it is being acted on by hydrostatic pressure, the male connector 144 reaches its maximum depth of engagement inside female connector 146 at which point, the male connector causes spring 148 to further compress as the piston 154 travels downward. In this fashion, the connectors 144 and 146 are engaged securely without the risk of having the piston 154 force the male connector 144 into the female connector 146 and damage the connectors or the power electrical source.

Figure 8:
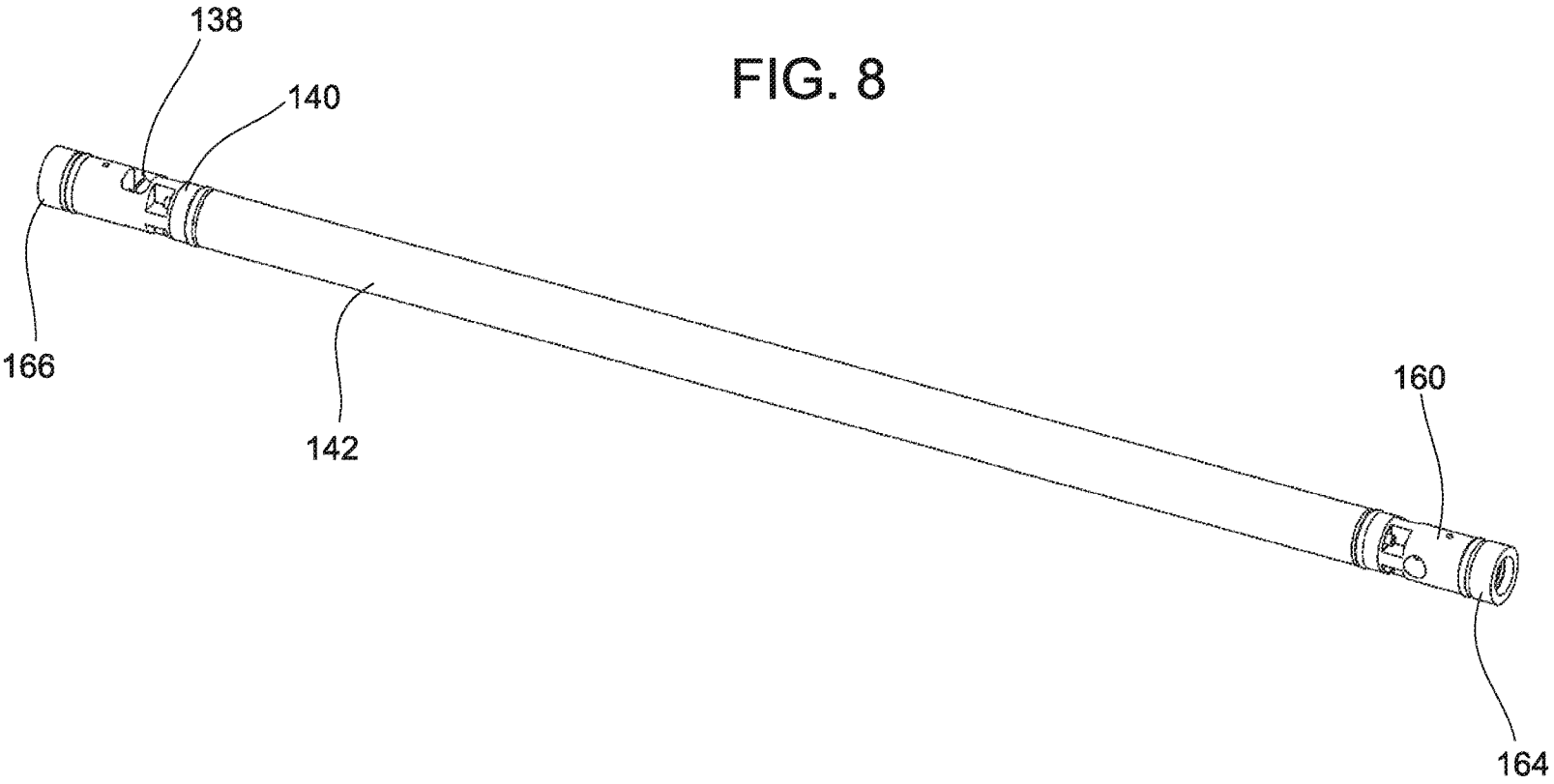
FIG. 8 is a three dimensional view of the electrical power source and generally provides details on the vibration isolation system that may be used with the electrical power source.

FIG. 8 generally shows a three dimensional view of the internal components that make up the electrical power source for the MWD tool 10 in the present embodiment. The electrical power source consists of a suitable power source or battery cartridge 142 which has been built into a cylindrical fashion with connectors on both sides. At the time of the invention, the preferred power sources are chemical batteries of the alkaline or lithium thionyl chloride type of DD size that have been packaged into battery cartridge 142.

The battery cartridge 142 is attached to a lower battery adapter 140 which contains an electrical power source fuel gauge 138. The fuel gauge 138 is assembled onto the cartridge 142 and remains attached for the life of the power source so as to provide a reliable measure of the remaining power. As the available power in the cartridge 142 is depleted, the cartridge 142 is either replaced or recharged as appropriate to the chemistry of the cells contained within. It is further contemplated that battery connector 141 and battery connector 143 may be respectively used at either end of battery or power source cartridge 142 such that rotatable connections are utilized. It is understood that batteries utilized as power source cartridge 142 may be known in the art and rotatable connectors 141 and 143 may be utilized to improve the connections from standard batteries known in the art.

The battery cartridge 142 is also attached to an upper battery adapter 160 which contains the wiring necessary to interface a battery power source used to the pressure sensitive switch 72 shown in FIGS. 6 and 7. In addition, both the upper and lower battery adapters 160 and 140 are supported with radial o-rings 156 to provide lateral support for the assembled cartridge 142 inside a battery housing 162. It is understood that the power source may be made of multiple batteries and or battery cartridges.

Figure 9:
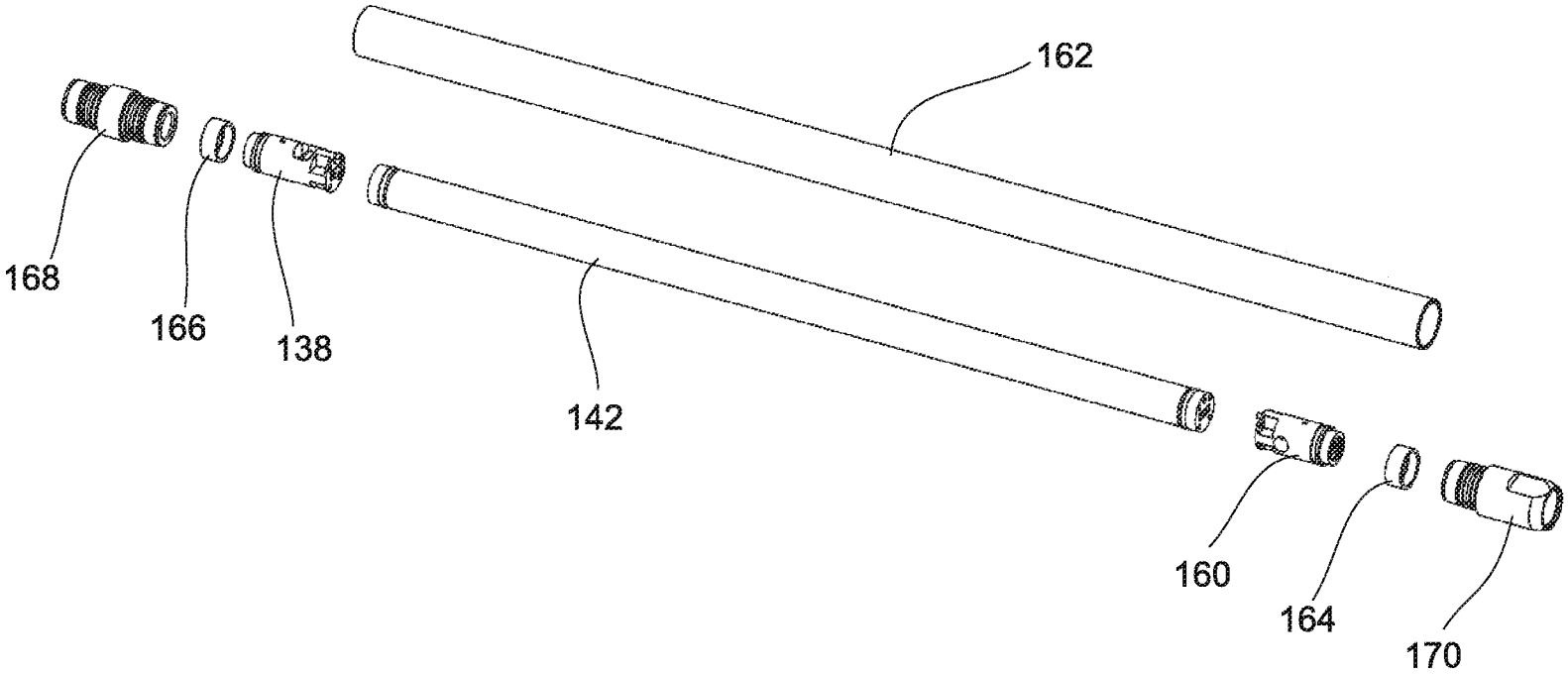
FIG. 9 is an exploded three dimensional view of an electrical power source in the present embodiment generally showing the vibration isolation mechanism used.

FIG. 9 generally shows the electrical power source subassembly 96. Battery cartridge 142 is attached as previously described to upper and lower adapters 160 and 140 respectively. Elastomeric vibration isolators 164 and 166 are then placed onto the ends of the upper and lower adapters 160 and 140 and the resulting assembly is inserted into the battery housing 162. The lower end of the battery housing 162 is threaded onto bulkhead 168 while the top end of the battery housing 162 is threaded onto bulkhead 170 which also retains the pressure sensitive switch assembly 72 (not shown in FIG. 9). The elastomeric vibration isolators 164 and 166 are made so that the cartridge 142 together with adapters 140 and 160 and the isolators 164 and 166 are slightly longer in length than the available length inside battery housing 162. Thus, the act of threading the bulkheads 168 and 170 onto the battery housing 162 causes the elastomeric isolators 164 and 166 to be compressed and in turn compress the entire battery cartridge assembly 142 inside the power source subassembly 96. This axial compression of the battery cartridge 142, in addition to the radial support of the o-rings 150 and 156 described previously contain the battery cartridge 142 in such a manner inside the battery housing 162 so as to not allow the battery cartridge 142 and its associated adapters 160 and 140 and connectors to come into contact with any metal. This isolation ensures that high frequency vibrations and shock caused by the drill process, which are transmitted through the drill string 32 into the casing of the MWD tool 10 are generally not communicated to the battery cartridge 142.

In essence, the use of elastomeric isolators 164 and 166 in compression with the battery cartridge 142 causes the subassembly 96 to behave as a highly damped mechanical filter. The resulting mechanical low pass filter is very effective at dampening out high frequency shocks and vibrations from damaging the electrical connections internal to the electrical power source subassembly 96.

In addition, the battery cartridge assembly 142 is allowed to spin inside the battery housing 162 if the shocks overcome the ability of the elastomeric isolators 164 and 166 to restrain the cartridge 142 from moving. This ability to rotate as necessary ensures that no undue stresses can be carried by the case of the battery cartridge 142 and that the battery cells themselves do not rotate or twist and lose electrical connectivity.

Figure 10:
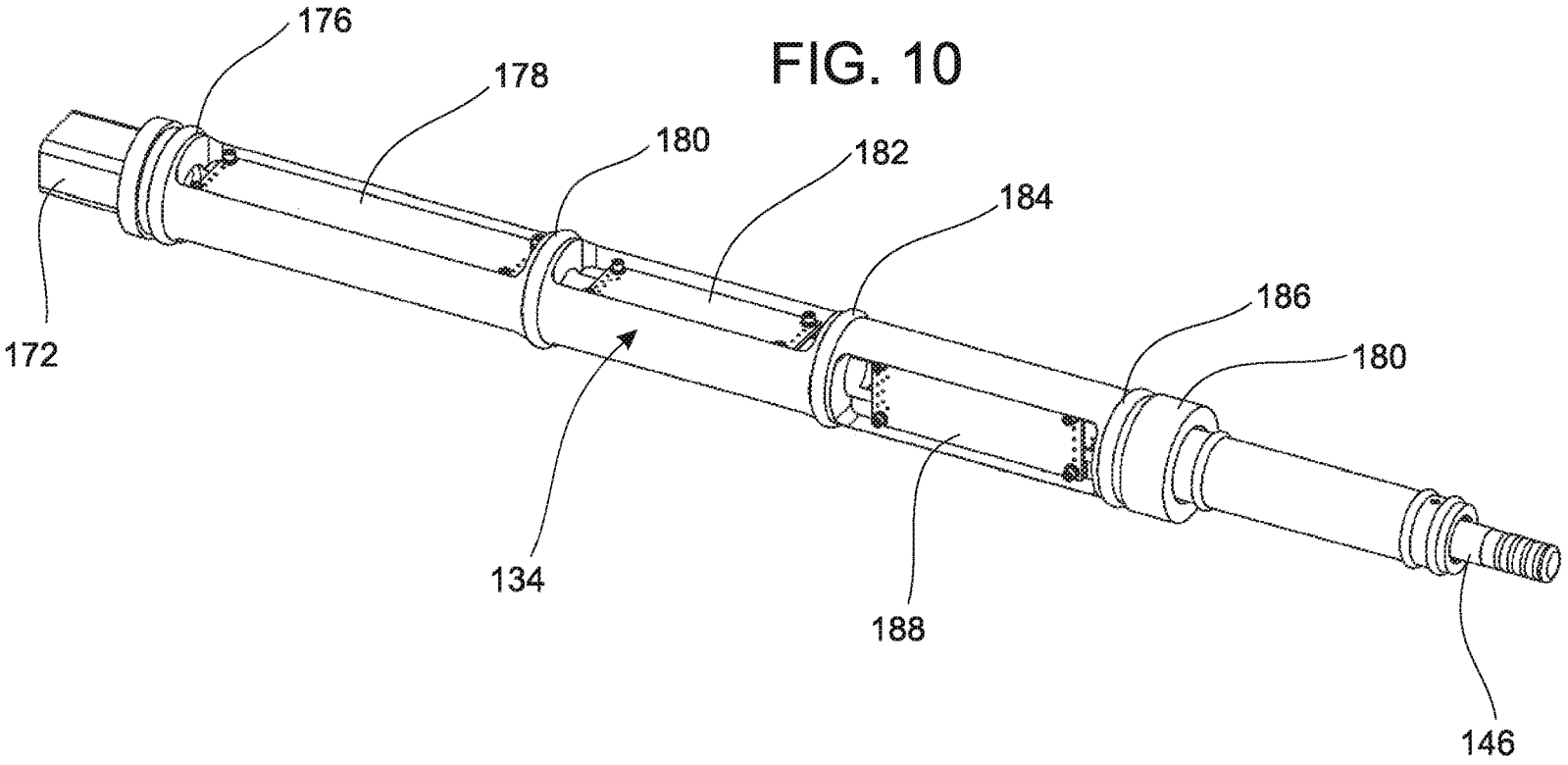
FIG. 10 is a three dimensional view of the downhole electronics package and generally provides details of the vibration isolation mechanism that may be used with the electronics package.
Figure 11:
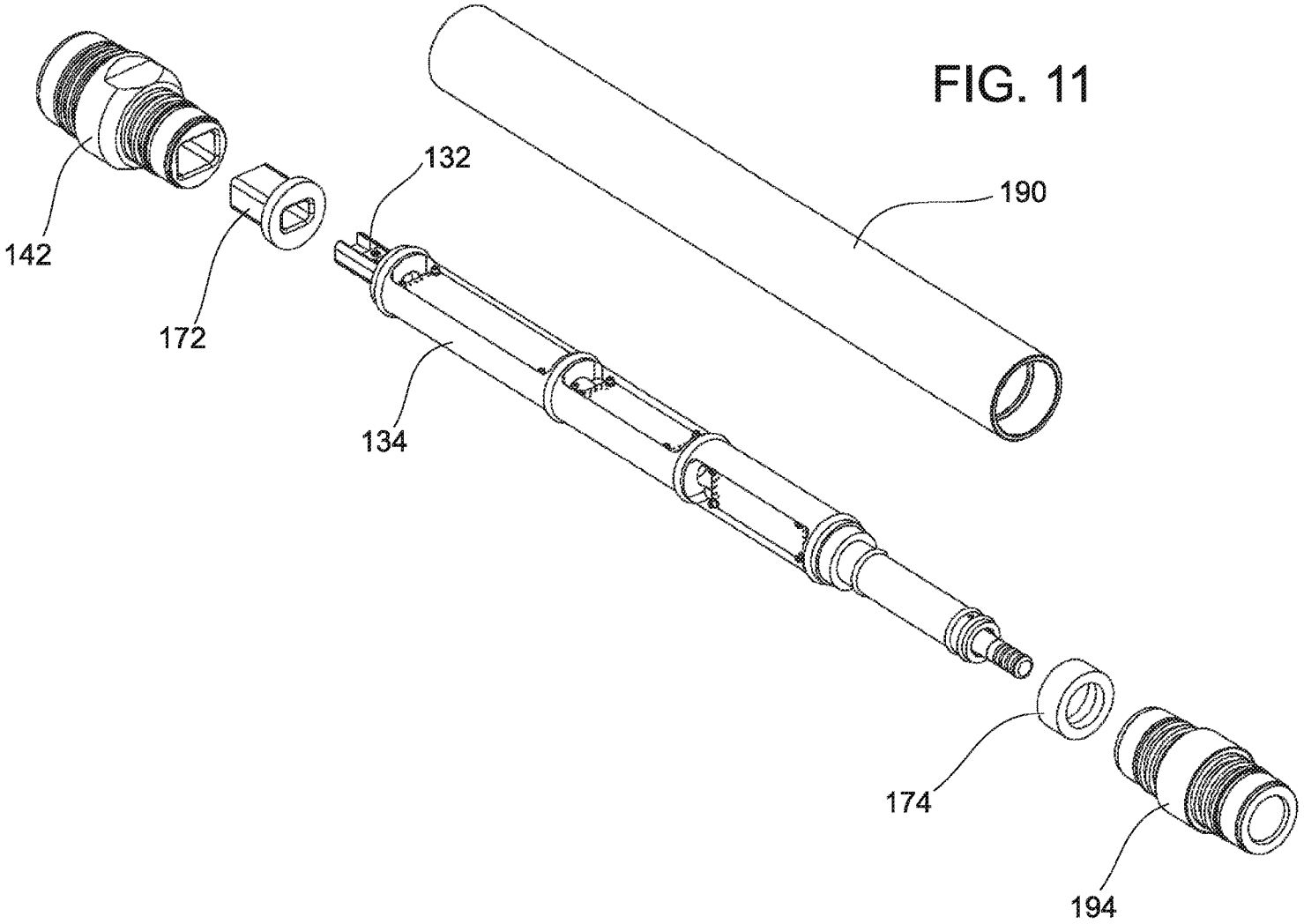
FIG. 11 is an exploded three dimensional view of the downhole electronics package in the present embodiment generally showing the vibration isolation mechanism.

FIGS. 10 and 11 generally show three-dimensional views of the electronics assembly 94 in the present embodiment of the invention 10. The electronics assembly 94 consists of a chassis 134 onto which a plurality of printed circuit boards 178, 182, and 188 (and others not shown) may be mounted. These printed circuit boards 178, 182 and 188 contain the electrical circuitry that make up the controller subassembly as generally depicted in FIG. 3 including the power supplies 74, sensor package 78 and the vibration sensitive switch 80. The chassis 134 has an electrical connector 136 of a rotatable type at its upper extremity. This male connector 136 is similar to the male connector 144 used in the pressure sensitive switch assembly 72. Electrical connector 136 is used to interface the electronics assembly 94 to the lower end of the electrical power source subassembly 96 and thereby derive power from the battery cartridge 142 and also allow the electronics assembly 94 to communicate with the electrical power source fuel gauge 138 as needed. It is contemplated spring 137 may be utilized as a pretensioner.

In addition, the chassis 134 also has electrical connector 132 at its lower extremity that is mounted onto a rectangular protrusion in the chassis 134. This electrical connector 132 provides the interface between the electronics assembly 94 and the pulser drive subassembly 92 described later.

The chassis 134 is supported radially by o-rings 176, 180, 184 and 186 that serve to retain the chassis 134 in the center of an electronics housing 190. In addition, the top end of the electronics assembly 94 is supported by elastomeric vibration isolator 174 which is similar to the isolators 164 and 166 used in the electrical power source subassembly 96.

The lower end of the electronics assembly 94 is supported by a different elastomeric isolator 172 which is manufactured to fit over the rectangular protrusion at the bottom of the chassis 134. This rectangular isolator 172 is then inserted onto bulkhead 192 which serves to orient the electronics chassis 134 relative to the bulkhead 192 so as to not allow the electronics chassis 134 to rotate. This keying of the electronics chassis 134 to the case of the tool 10 while simultaneously isolating the chassis 134 from all mechanical metal to metal contact with the case of the tool 10 allows the invention 10 to measure the rotational orientation of the MWD tool 10 relative to magnetic north or the earth's gravity vector while at the same time protecting it from harmful high frequency shocks and vibrations present during the drilling of bore holes.

As with the electrical power source subassembly 96, the electronics chassis 134 together with the two elastomeric isolators 172 and 174 and bulkhead 192 is inserted into electronics housing 190 at which point a top bulkhead 194 is threaded onto the electronics housing 190. As with the electrical power source subassembly 96, this compresses the elastomeric isolators 174 and 172 and retains the electronics chassis 134 at the center of the electronics housing 190 while simultaneously acting as a highly damped mechanical filter capable of filtering out high frequency shock and vibrations and prevent them from reaching the sensitive electronic components, connections and connectors that are part of the printed circuit boards 178, 182 and 188.

Figure 12:
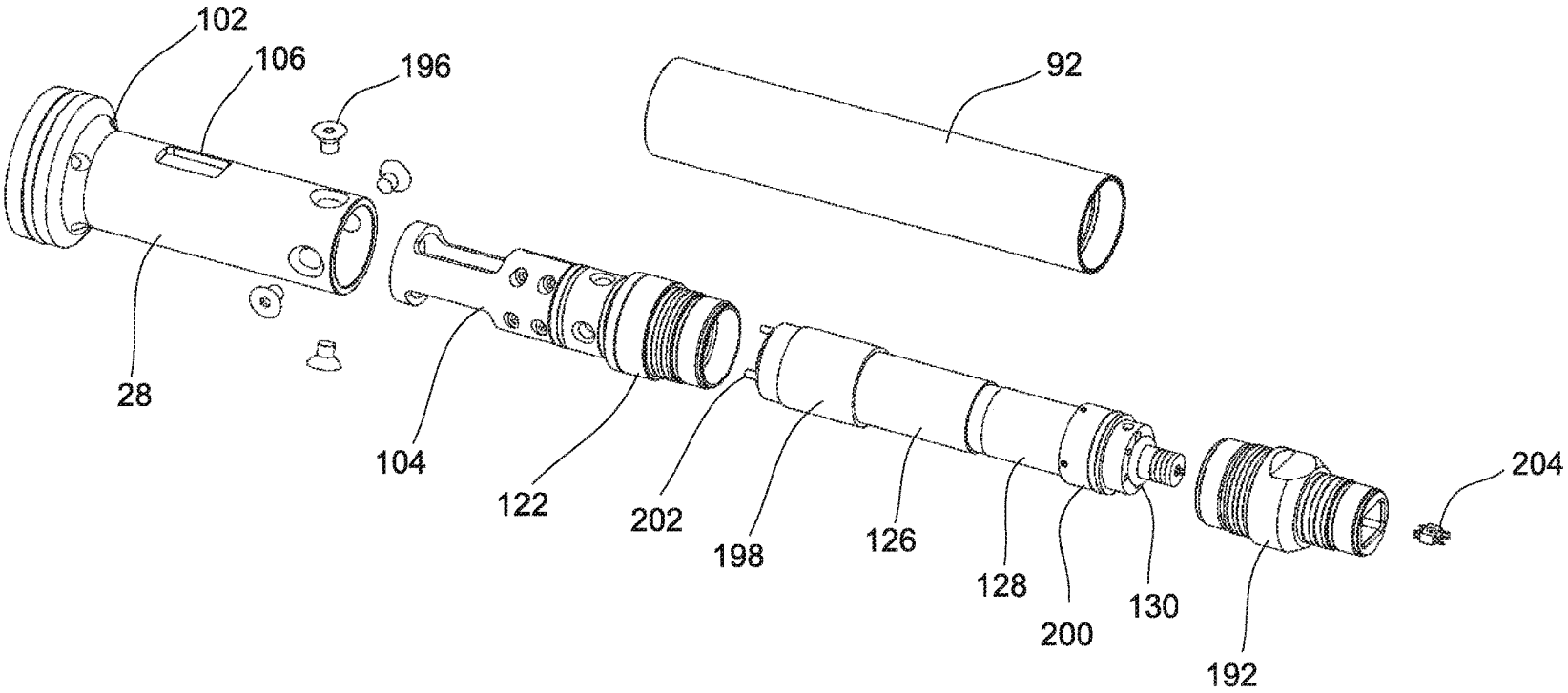
FIG. 12 is an exploded three dimensional view of a pulser detailing the stator, rotor, drive shaft and the geared electric motor drive. This exploded view generally shows the rotor in the open position.

FIG. 12 generally shows a three-dimensional exploded view of the bottom half of the present embodiment of the present invention 10 and comprises the pulser valve 82 and the pulser drive subassembly 92.

FIG. 13 generally shows a three-dimensional exploded view of the pulser drive subassembly 92 which consist of gearbox 126 and electrical motor 128 which are coupled to shaft coupling 206 which contains the stop dowel pin 208. The gearbox 126 is attached to a gearbox retainer 198 using screws 212. The gearbox retainer 198 has machined onto it an hourglass shaped cutout 210 inside which the coupling 206 and the stop dowel pin 208 are inserted. This provides a means whereby the rotation of the shaft 207 of gearbox 126 can have hard stopping points allowing motion only between two predetermined portions of the revolution.

The motor 128 is attached to motor retainer 200 with screws 214. In addition to providing radial and axial support for the motor 128 inside the pulser drive subassembly 92 housing, the motor retainer 200 also provides a path to connect the electrical terminals of the motor 128 to electrical bulkhead seal 216. The electrical bulkhead seal 216 is installed inside the motor retainer 200 and serves to protect the electronics assembly 94 and the electrical power source sub assembly 96 from being flooded in case of failure of main pulser shaft seals 110 and 112 (FIG. 15) while at the same time allow electrical contacts to be fed through to connector 204 which is used to interface the pulser drive subassembly 92 to connector 132 in the electronics assembly 94.

Figure 14A:
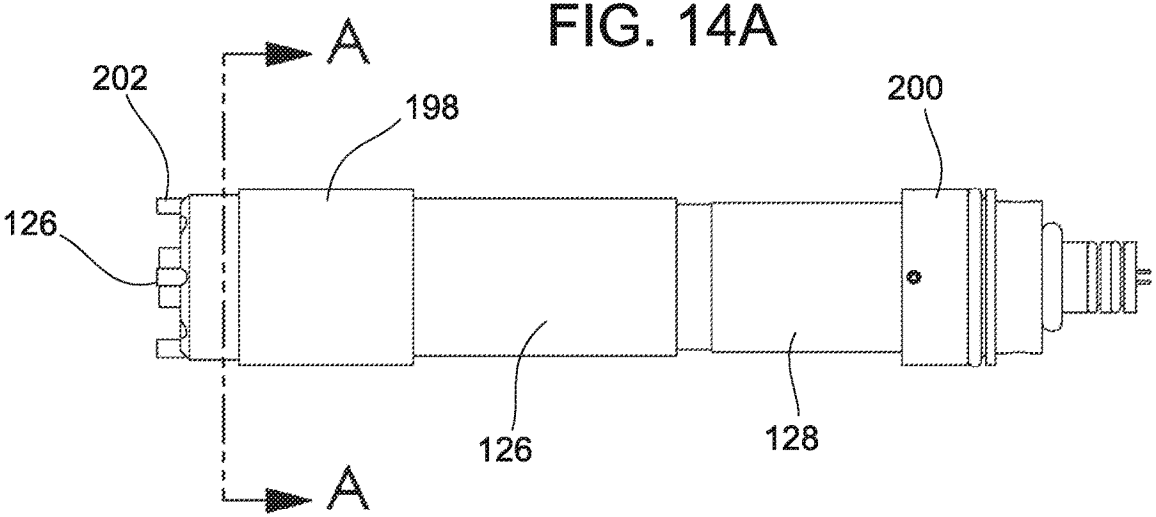
FIGS. 14A, 14B and 14C provide a cross-sectional view of a geared electric motor drive.
Figure 14B:
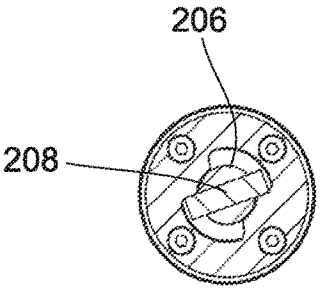
Figure 14C:
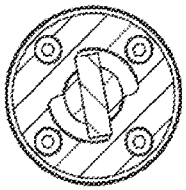

FIG. 14A generally shows an assembled view of the pulser drive subassembly 92. FIG. 14B shows a cross-sectional view of the gearbox retainer 198, coupling 206 and stop dowel pin 208. In this drawing, the stop dowel pin 208 is shown in a position that would correspond to the open position of the pulser valve 82. FIG. 14C shows the same cross-sectional view of the gearbox retainer 198, coupling 206 and stop dowel pin 208 with the pulser valve 82 in the closed position. The electronics assembly 94 and specifically the processor 76 creates the described pressure pulses by rotating the motor 128 and therefore the gearbox 126 between these two extremities.

FIGS. 13 and 14A also generally show locating dowel pins 202 that are pressed onto gearbox retainer 198. These locating dowel pins 202 are used to orient the pulser drive subassembly 92 and specifically the gearbox retainer 198 and the stop dowel pin 208 to bulkhead 122. This orientation allows the rotation of the stop dowel pin 208 between its extremities to be keyed to the rotation of the rotor 104 and thereby orient the radial location of the rotor 104 with the stator 90 and its inlet openings 106.

The pulser drive subassembly 92 thus described is inserted onto the bulkhead 122 by locating the dowel pins 202 with matching holes in bulkhead 122 and inserted into pulser sub assembly 92 housing. Bulkhead 192 is then threaded onto pulser sub assembly 92 and used to retain the pulser drive subassembly 92 in place while allowing connector 204 to be fed through to connect to the electronics assembly 94. The act of threading on bulkhead 192 causes o-ring 130 to be compressed against the motor retainer 200 so as to put the pulser drive subassembly 92 into compression against bulkhead 122. It is further contemplated that high pressure secondary seal 131 may be utilized to prevent fluid from entering such as but not limited to the geared electronic components.

Figure 15:
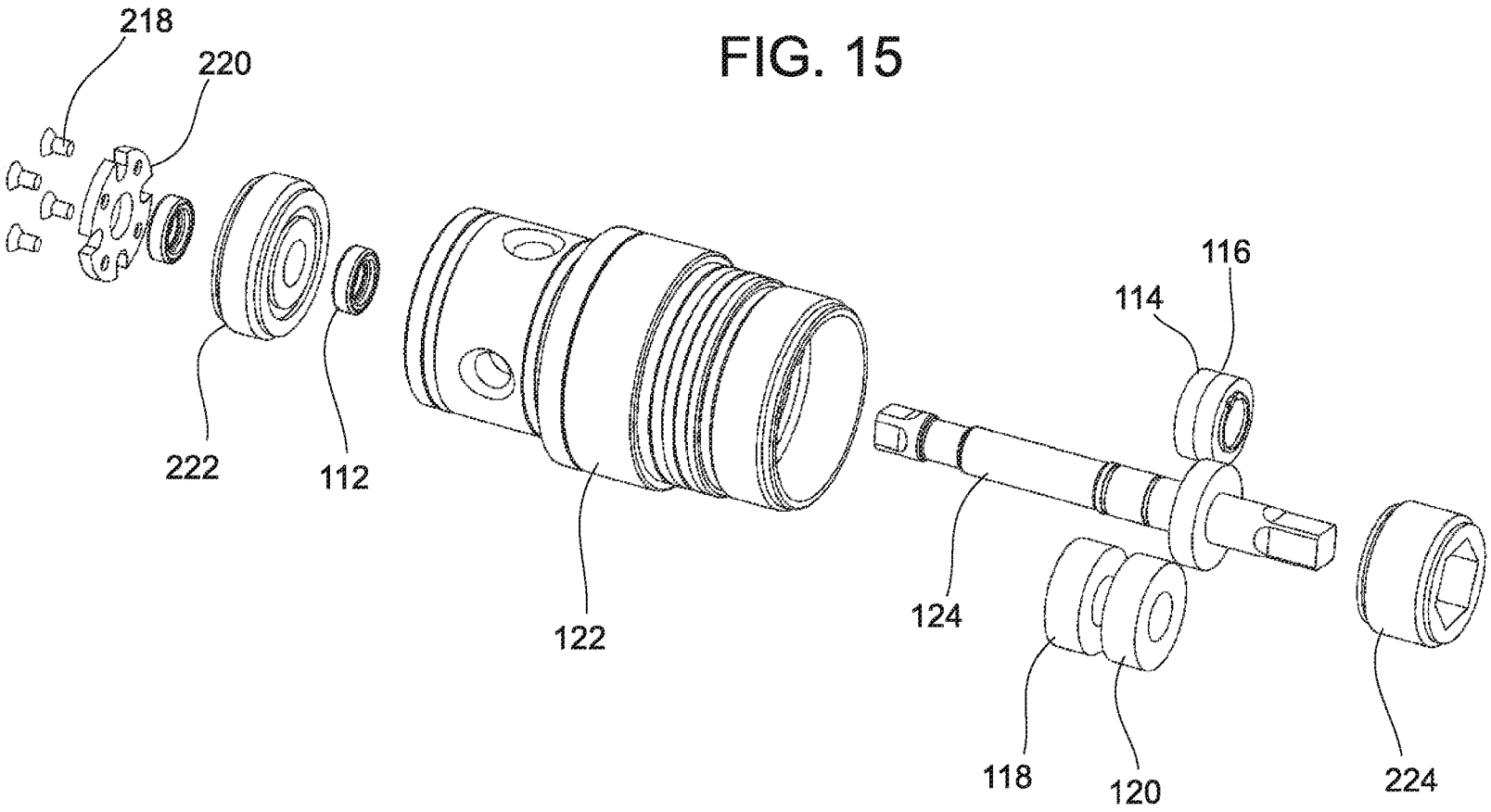
FIG. 15 is an exploded three dimensional view of a shaft assembly and generally provides details on the bearings and seals.

FIG. 15 generally shows an exploded three-dimensional view of a drive shaft 124 assembly in a preferred embodiment of the MWD tool 10. Drive shaft 124 is used to provide the linkage between the coupling 206 and the rotor 104. The drive shaft 124 is supported inside the bulkhead 122 with two radial ball bearings 114 and 116 and two thrust ball bearings 118 and 120. Thrust ball bearing 118 provides support to the drive shaft 124 while allowing it to rotate under the condition that the shaft 124 is being pulled downward (in tension) due to the loads on the rotor 104 cause by fluid flow past the rotor 104 and stator 90. Thrust ball bearing 120 is used to support the drive shaft 124 and allow it to rotate freely if the hydrostatic pressure of the fluid column exerts force onto the drive shaft 124 (in compression) and causes it to press inward towards the pulser drive subassembly 92. The drive shaft 124 with the bearings 114, 116, 118 and 120 is inserted into bulkhead 122 and the drive shaft 124 is retained inside the bulkhead 122 by thrust bearing nut 224.

The right (uphole) end of the drive shaft 124 has a rectangular shape which is the inverse of the rectangular shape at the end of coupling 206. This ensures that the coupling 206 and drive shaft 124 can only be aligned in one direction. In addition, the rectangular cutouts may act as a slip joint allowing the axial loads seen by the drive shaft 124 from being transmitted to the gearbox 126.

A high pressure elastomeric seal 112 is pressed onto the shaft 124 and is retained inside the bulkhead 122. This seal 112 is the primary means of sealing the inside of the MWD tool 10 from the pressures of the borehole environment. The seal 112 is preferably designed to have a high tolerance to wear induced by shaft rotation and have low friction so as to allow the shaft 124 to be rotated freely between stops under high pressure.

The seal 112 is further retained in place inside the bulkhead 122 by seal retainer nut 222 which in turn is used to carry a wiper or pulser shaft seal 110. The wiper or pulser shaft seal 110 is designed so as to prevent fine contaminants from entering the sealing surface of seal 112 as result in wear and leakage. The wiper or pulser shaft seal 110 is retained in place by wiper retension plate 220 and screws 218.

Figure 16:
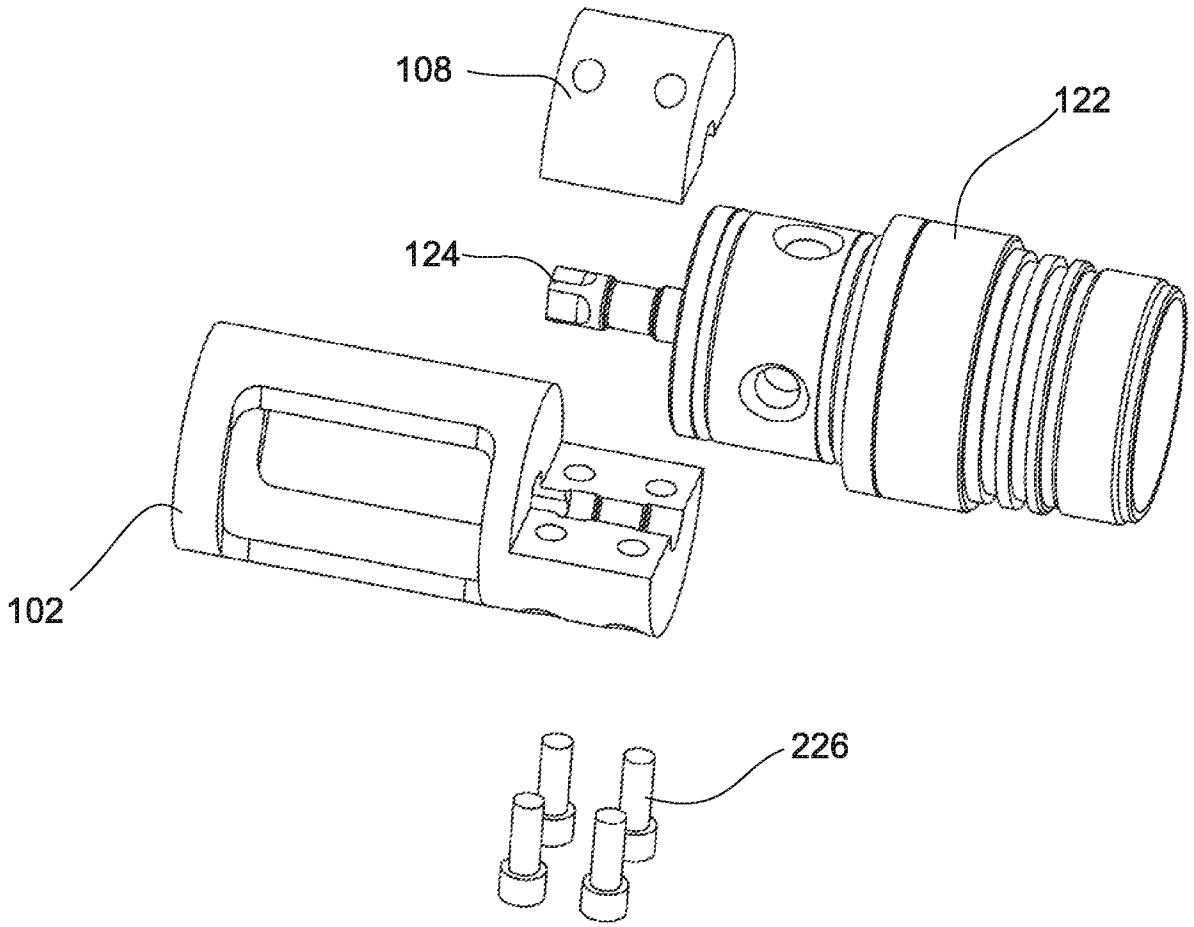
FIG. 16 is an exploded three dimensional view of a rotor and its clamp mechanism in relation to the drive shaft assembly.

FIG. 16 generally shows a three-dimensional view of the assembly drive shaft 124 inside bulkhead 122. The left (downhole) end of the drive shaft 124 has a rectangular shape and a cylindrical recess as shown. The rectangular cutout may be used to align the drive shaft 124 to the rotor 104 which has the inverse cutout while the cylindrical recess is used to provide an axial support mechanism for the rotor 104 as it is attached to the drive shaft 124. Aligning the rectangular cutouts radially and by placing the rotor 104 onto the drive shaft 124 and by using rotor clamp 108 and bolts 226 to attach the rotor assembly onto the drive shaft 124 causes the rotor 104 to be thus aligned to the stop dowel pin 208 through the drive shaft 124 and coupling 206.

Figure 17A:
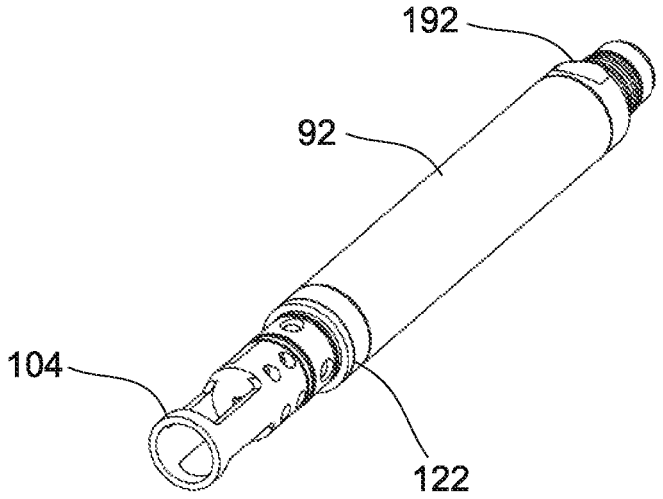
FIG. 17A is a three dimensional view of a rotor attached to a pulser in the open position.

FIG. 17A generally shows a three-dimensional view of the rotor 104 attached to the pulser drive subassembly 92. This figure shows the rotor 104 in the open position as it would be if the stop dowel pin 208 is in the position shown in FIG. 14B.

Figure 17B:
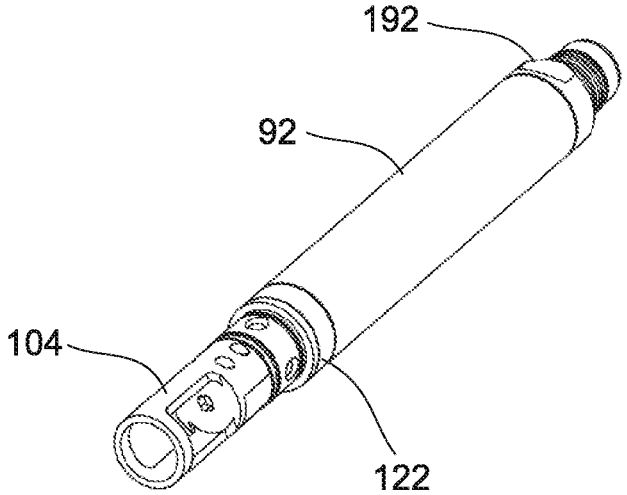
FIG. 17B is the same general assembly shown with the rotor in the closed position.

FIG. 17B generally shows the same three-dimensional view of the rotor 104 attached to the pulser drive subassembly 92 as FIG. 17A. This figure shows the rotor 104 in the closed position as it would be if the stop dowel pin 208 is in the position shown in FIG. 14C.

Figure 18A:
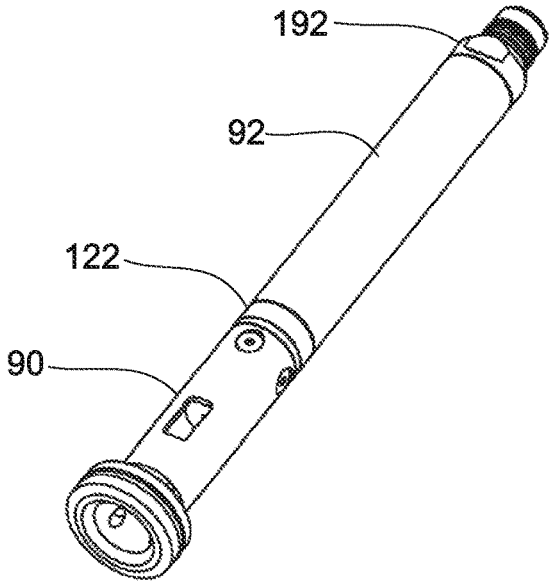
FIG. 18A is a three dimensional view of a pulser with the rotor, stator and drive mechanism shown in the open position.
Figure 18B:
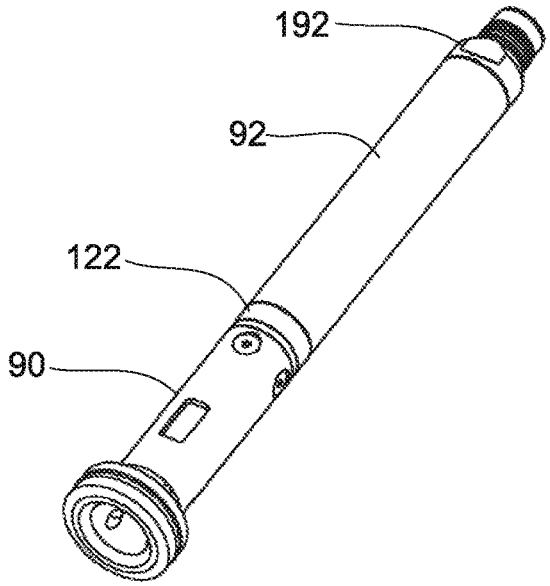
FIG. 18B is the same general assembly with a rotor shown in the closed position.

FIGS. 18A and 18B generally show the rotor 104 and pulser drive subassembly 92 with the stator 90 attached and held in place by bolts 196. FIG. 18A shows the lower half of the MWD tool 10 with the pulser valve 82 in the open position. Note that in this position, the inlet openings 106 in stator 90 are unobstructed and that drilling fluid pumped through the drill collar 36 can pass through the openings 106 in the rotor 104 and through the center of the rotor 104 and out through the bottom of the stator 90. In addition, the drilling fluid can also pass through openings 102 in the stator 90.

FIG. 18B generally shows the MWD tool 10 with the pulser valve 82 in the closed position. Note that in this position, the rotor 104 has been oriented in such a manner as to obstruct the inlet openings 106 in stator 90. In this form, the drilling fluid pumped through the drill collar 36 can only pass through the openings 102 in the stator 90.

Figure 19A:
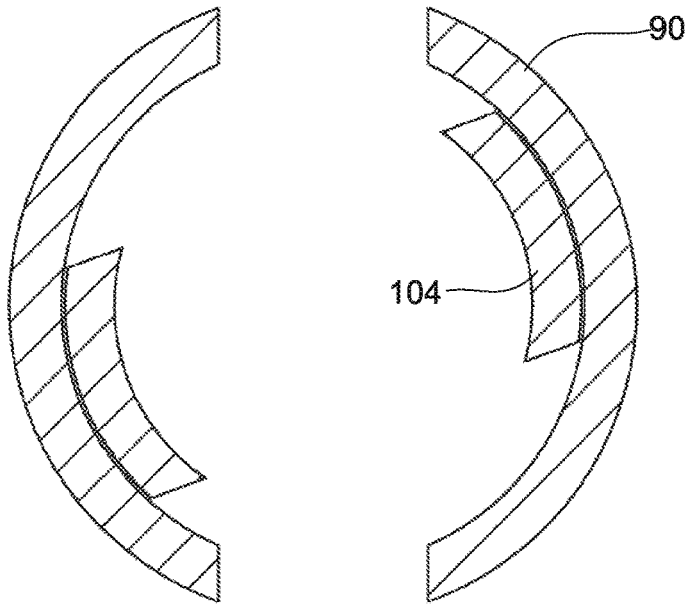
FIG. 19A is a two dimensional cut section view of a pulser with the rotor and stator shown in the open position.
Figure 19B:
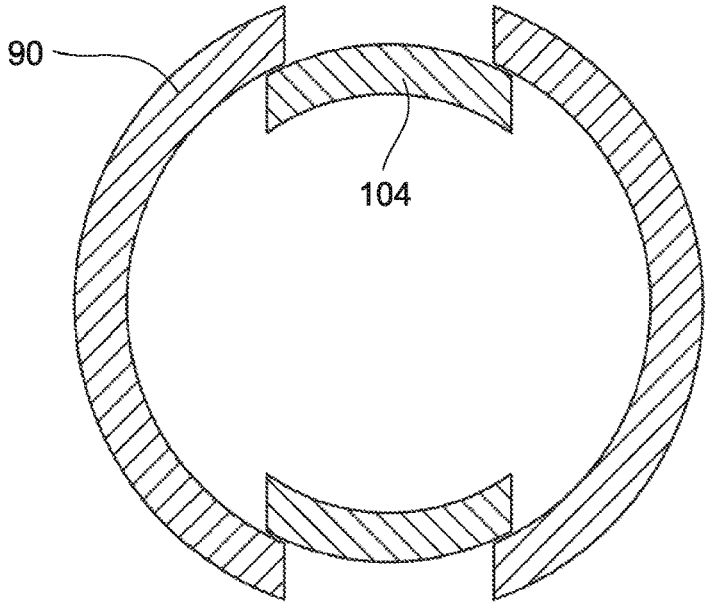
FIG. 19B is the same cross sectional view with a rotor generally shown in the closed position.

FIGS. 19A and 19B generally show a cross-sectional view of the MWD tool 10 of the present embodiment through the rotor 104 and stator 90 at the location of the inlet openings 106. FIG. 19A shows the MWD tool 10 in the open position with the inlet openings 106 unobstructed and FIG. 19B shows the MWD tool 10 in the closed position with the inlet openings 106 closed and the previously described restriction created.

It is understood that a person skilled in the art can see that by varying the diameter and number of the openings 102 in the stator 90 and by varying the clearance between the outer diameter of the rotor 104 and inner diameter of the stator 90, restrictions of various magnitudes and degree can be created. Furthermore, by varying the width and length of the inlet openings 106 in the stator 90 and their corresponding openings in the rotor 104, pulses can be generated by not closing the rotor 104 all the way, or by only partially obstructing the inlet openings 106. Also, pulser valves 82 of various shapes, amplitude and character can be created by carrying the speed of closure of the rotor 104 relative to the stator 90.

In another preferred embodiment, pulses may be generated by eliminating the stop dowel pin 208 and by rotating the shaft 124 through completely. With the rotor 104 and stator 90 in the current embodiment, one revolution of the shaft 124 causes two pressure pulses to be generated. By varying the rotation speed of the shaft 124 intermittently or by changing the speed of the shaft 124, pulses can be created at varying frequencies and data can be transmitted using frequency of phase shift keying.

In still another preferred embodiment, the number of inlet openings 106 in the stator 90 and the number of the corresponding cutouts in the rotor 104 can be varied to provide more pulses per revolution of the shaft 124. In addition, by mismatching the number of inlet openings 106 and the openings in the rotor 104, pulses can be created whose position is a non-linear function of time. Furthermore, it is possible to conceive of a combination of rotor 104 and stator 90 passageways that allow for pulses that are created in increasing frequency so as to create a chirping effect.

Also, by varying the location and number of inlet openings 106 and the rotor 104 openings, rotation of the shaft 124 can cause pulses of varying size, shape and frequency to be created with the shaft 124 rotating at a constant speed. It will also be apparent to an individual skilled in the art that the rotor 104 can be oscillated between the open and closed position as described in the present embodiment to create the same affect as can be accomplished without stops. In addition, the rotor 104 can be rotated in either direction so as to equalize the fluid induced wear on the rotor bladelike surfaces.

Furthermore, it is understood that providing the appropriate radial support centralizers (of spring type or collapsible) the MWD tool 10 of the present invention can be modified to become a retrievable tool that can be retracted from the bore well through the ID of the drill string 32 without having to remove the drill string 32 from the bore well.

In another preferred embodiment, the invention may include combining all the separate electronic parts of the tool 10 into one shortened section that can be built directly onto the back of the motor retainer 200. Furthermore, the invention 10 may include replacing the battery power supply with a suitable downhole turbine generator which will extract power from the fluid circulation flow.

In accordance with another preferred embodiment of the invention, the MWD tool 10 may constantly transmit data to the surface such as tool face. In a preferred embodiment, the invention may have the fluid flow rotate the rotor 104 all the time continuously. This may make pulses at all times and may allow use of the gearbox 126 and motor 128 as a brake to vary the speed of the pulses to send data. It is contemplated that this may be like controlling the frequency of pulses using the motor 128 and gearbox 126 as an electrical clutch and alternator and wherein straight frequency shift keying of the data is accomplished.

It is further contemplated that the invention may include use of a fluid to rotate the rotor 104 and use the gearbox 126 and motor 128 as brute force brake. It is therefore contemplated that the frequency is not generally controlled, but could make the frequency suddenly stop or distort the carrier wave pulse such as but not limited to phase shift keying.

In accordance with another preferred embodiment of the invention, it is contemplated that varying geometries may make components more wear resistant to fluid induced washing and erosion. Furthermore, it is contemplated that other sensors may measure lithological parameters. Still furthermore, it is contemplated that the invention may use an on/off of fluid flow to send detailed commands to the downhole MWD tool 10 to reprogram it between modes. By example, one combination of ons and offs may mean sending inclusive information whereas another combination means sending only angle, or another combination means only angle and direction.

Still furthermore, it is contemplated that the invention may not only send and measure battery level or levels, but further include real time battery warning levels telling operators when they may be about out of power.

METHOD OF USING THE INVENTION

In a preferred embodiment of the invention described above is the MWD tool 10 capable of measuring desired parameters at the bottom of a bore hole during the drilling process and on command, communicate these parameters, suitable encoded, to the surface using a series of pressures pulses in the circulating fluid where the pressure pulses and measured, detected, decoded and the embedded information retrieved and displayed to the driller.

The process of commanding the MWD tool 10 to make a measurement may be initiated by the driller at the surface. During the drilling process and when desired, the driller may initiate the transmit command by first stopping rotation of the drill string 32, then lifting the drill string 32 a few feet off the bottom of the bore well, and stop the flow of circulating fluid by turning off the pumps as is common practice in the drilling process. With the drill string 32 in this position, the driller waits a predetermined amount of time, preferably less than one minute to allow the downhole MWD tool 10 to detect the absence of motion and vibration induced by the drilling process or the fluid flow. It is understood that more or less time is contemplated.

Upon seeing the cessation of motion and vibration, as may be signaled to the processor 76 by the vibration sensitive switch 80, the processor 76 communicates with the sensor package 78 and the electrical power fuel gauge 70 and gathers pertinent information about the nature of the parameters being measured. In a preferred embodiment, these measurements are the inclination of the bore well, the azimuth of the bore well, the temperature at the bottom of the bore well and the remaining fuel capacity of the power source. These measurements may be encoded into discrete "words" and are readied for transmission to the surface.

At the surface, upon completion of the specified time such as but not limited to 1 minute, the driller restarts the flow of circulating fluid through the drill string 32. The downhole MWD tool 10 detects the resumption of fluid flow as signaled to the processor 76 by the vibration sensitive flow switch 80, and begins a predetermined delay period preferably less than one minute. This delay may be used to ensure that the pumps have sufficient time to attain their target flow rate and allow the fluid flow to stabilize.

At the end of this delay, the downhole processor 76 initiates transmission of the survey by commanding the pulser valve 82 to send a sequence of pulses whose purpose is to signal the start of transmission. In the preferred embodiment, the start of transmission or "sync" (abbreviation for synchronization) is signaled by causing the rotor 104 to move from its open position to its closed position, thereby creating a restriction to the fluid flow and then subsequently returning the rotor 104 to its open position thus relieving the obstruction. This process of closing and then opening the valve 82 by moving the rotor 104 from the open position to the closed position and then returning it to the open position creates single "pulse". The sync is sent as two pulses, one immediately following the other to create two pulses next to each other.

After the sync is sent, a plurality of other pulses are sent by the MWD tool 10 to the surface to transmit the measured information. Each pulse following the sync can occur one of several, but finite number of locations and each location is used to encode a specific value for the transmitted information. For example, a single pulse might be used to encode a value from 0 to 9 thereby allowing 10 possible positions in which that pulse may occur, each position being shifted from the previous position by a time interval of one second. A pulse occurring at the first available position could be used to encode the number 0 while the pulse used to encode the number 9 would have the rightmost position and is shifted 9 seconds to the right relative to the first position.

An individual experienced in the art can see that by transmitting a series of pulses relative to the sync signal and by placing these pulses at different locations relative to the sync pulse, a sequence of numbers can be transmitted from the downhole MWD tool 10 to the surface. The numbers thus transmitted can then be decoded using a priori knowledge of the encoding process to recover the transmitted information.

Upon completion of the sequence of pulses, the downhole MWD tool 10 can enter into a low power mode to conserve power and can check the status of the vibration sensitive switch 80 periodically to begin this process over again as commanded from the surface.

In a preferred embodiment of the invention, a survey may be conducted by the following operation, although the below example should not be considered limiting the scope of the invention. In accordance with the invention, the downhole MWD tool 10, in the sensor/electronics package 94, has a flow switch that may comprise a small vibration sensor. When pumps are ON, the tool is vibrating and vice versa. It is contemplated that most of the time the tool could be idle while drilling ahead.

It is contemplated that a survey may have the following steps:

1) Pick off bottom a few feet to make sure they do not plant the bit into the rock.
2) Circulate their cutting out to make sure they do not pack off the bit.
3) Stop rotating the pipe.
4) Stop the pumps.
5) Hold still for a minute.
6) The downhole tool may see that the tool has stopped moving and 20 seconds later, it turns on the sensor package, and after a few seconds for warm up, gets the angle, inclination, bottom hole temperature and also talks to the battery gauge to get the hours remaining on the pack.
7) It then turns of the sensors to conserve power and waits (until the end of time if it has to).

8) After the minute, the rig crew brings the pumps back ON. This causes the downhole tool to see motion and the electronics then waits a full extra minute to allow the pumps to stabilize.

It then sends up the survey.

Operators may see instructions for operations such as:

1) Pick off bottom.
2) Stop pumping for one minute. Keep the pipe still.
3) Turns pumps ON.
4) Within minute, the pulses will start.
5) When the survey is done, drill ahead.

The survey may be encoded in a preferred embodiment as follows for generally the angle and azimuth, the survey is encoded in 10 pulses wherein pulse 1 and pulse 2 are synchronization pulses. They may be unique in that the time between the two pulses is never repeated elsewhere. This may allow the ability to latch onto the start of the survey.

Pulses 3, 4 and 5 may be angle pulses. Pulse 3 may contain the 10's digit of angle, pulse 4 the units and pulse 5 the tenths. Where these pulses occur in time is the number. That is, if pulse number 3 occurs at time 34.5 sec, then the number is 3, if it occurs at 35.5 sec, the number is a 4, etc.

Pulses 6, 7 and 8 may be the azimuth information. Pulse 6 may be the hundreds digit, pulse 7 may then be the tens digit and pulse 8 may be the units digit. Pulse 9 may be the status bit. It may contain the information on such things as a low battery, over temperature warnings, and so forth. Pulse 10 may be the check sum.

On another embodiment, the surveys may be where pulses 1 and 2 are the sync, pulses 3 and 4 are the angle, pulse 5 may be the status, and pulse 6 may be the check sum. It is understood that numerous variations may be utilized in the transmission of information.

Active Electromagnetic System for Subsurface Collision Avoidance

The accidental intersection of adjacent, producing wells is a known hazard in drilling operations. Many companies have had moderate success with "passive" monitoring, observing for changes in Earth Field magnetic readings to detect adjacent well casing before it is intersected during the drilling process of new well. Still other companies have used "active" monitoring to detect adjacent pipe, often using wire line-conveyed electromagnets in the adjacent pipe to radiate a detectable signal for generally locating and avoiding the adjacent pipe. While the latter method is often effective, it is not very desirable in that it requires the shutdown of the adjacent well and the danger of losing wire line and/or tool in an already profitable well.

It is contemplated to provide an attachment to a down hole tool wherein an electrical signal is generally generated atop or near the drill bit and generally received at same and or near the MWD tool. It is also contemplated to produce an electrical signal generally near the MWD tool and generally received at same and or near the drill bit. In a preferred embodiment, the electrical signal generated fluctuates in the presence of an adjacent pipe and or metal obstructions and said fluctuations are observed by the signal receiver. It is contemplated that the information regarding the flux or electric field changes may be communicated to the MWD tool wherein a mud pulse is generated to convey such information to the surface. It is further contemplated that the information regarding the flux or electric field changes may be communicated to the surface utilizing long distance EM, electromagnetic, telemetry and or short range EM telemetry.

Figure 20:
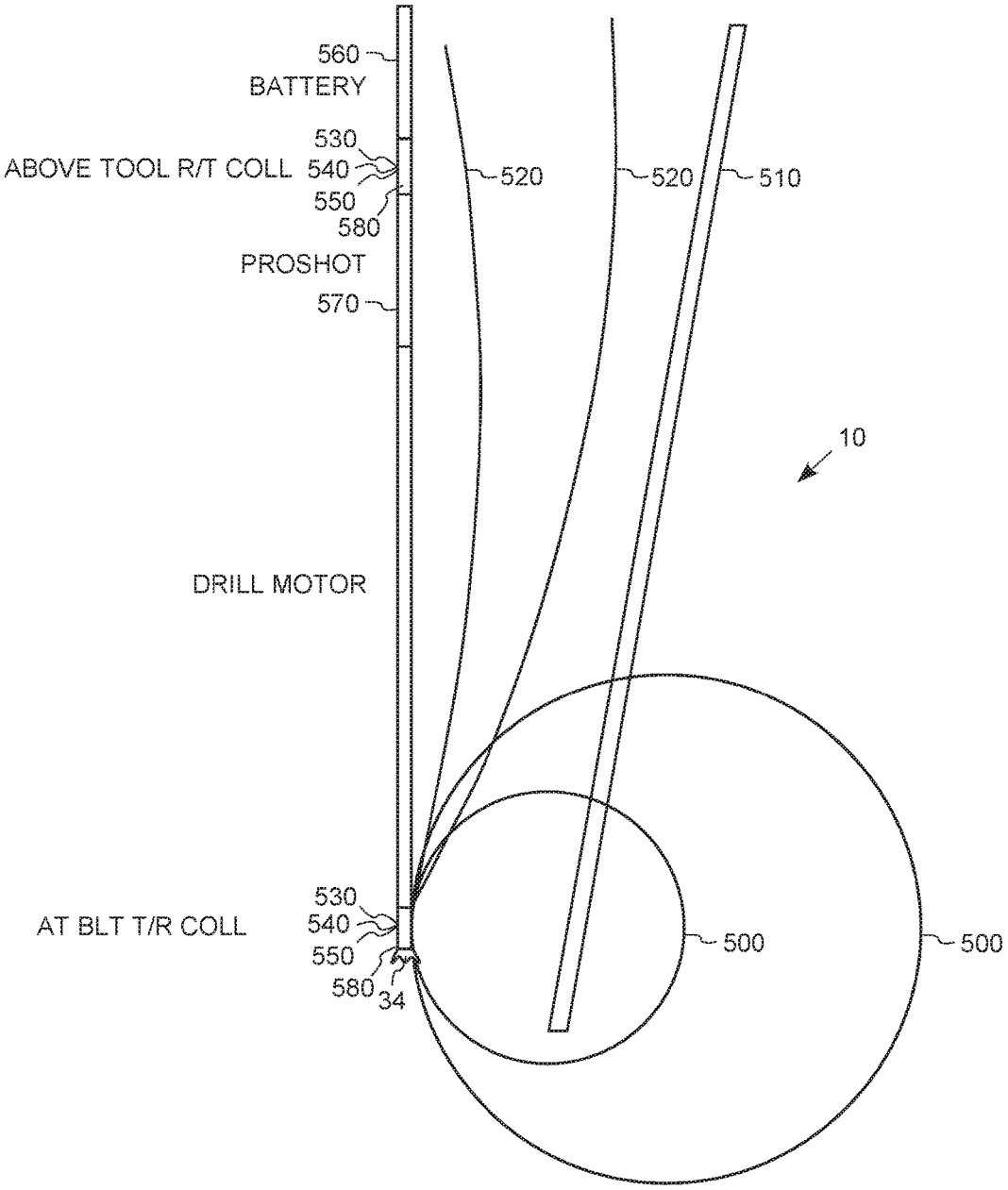
FIG. 20 is a general illustration of a preferred embodiment depicting an electrical signal generated and received when encountering an adjacent pipe and when not encountering a drill pipe in accordance with the invention.

FIG. 20 generally shows flux or electric field lines 500 generated at or near the drill bit 34 wherein no adjacent casing and or pipe 510 is present. Although the illustration does generally depict the adjacent pipe 510 for purposes of further discussion below, pipe 510 should be considered absent for purposes of illustration of flux or electric field lines 500. Flux or electric field lines 520 generally depict the fluctuation that may occur when in the presence of pipe 510. It is understood that depiction of flux or electric field lines 500 and 520 are for purposes of illustration and that fluctuations may occur in different fashions and means.

Invention 10 generally contemplates one or more flux, electric and or acoustic field system 530 that may include a flux, electric, and or acoustic field generator 540 and or flux, electric, and or acoustic field receiver 550. It is understood that flux, electric, and or acoustic field system 530 may also include an independent power source and or utilize the power source 560 of MWD tool 570. Still furthermore, flux, electric, and or acoustic field system 530 may further include a communications system 580 such that one flux, electric, and or acoustic field system 530 located at or near the drill bit 34 may communicate with another flux, electric, and or acoustic field system 530 attached or near the MWD tool 570 and or other flux, electric, and or acoustic field system 530 and or system in general. It is understood that invention 10 may utilize combinations of flux, electric, and or acoustic elements.

It is contemplated that putting an active device and or intelligent electromagnet flux, electric, and or acoustic field system 530 atop drill bit 34 will provide a strong pulsed field that may be more detectable by flux, electric, and or acoustic field system 530 flux, electric, and or acoustic field receiver 550 above or near the MWD tool 570 in the presence of adjacent casing 510 rather than absence. It is also contemplated that MWD tool 570 may include a serial port available to flux, electric, and or acoustic field system 530. It is contemplated that MWD tool 570 may be a "tool bus" for connection to different element such as but not limited to flux, electric, and or acoustic field system 530 that can convey commands and data between MWD tool 570 and a transmit and receive device above ground.

It is therefore contemplated invention 10 may be a wireless tool inserted down hole for providing drilling information during the drilling process comprising an electrical power source; a pressure sensitive switch; a sensor package; a vibration sensitive switch; a processor; a pulser valve used to create an obstruction in the path of fluid flow to generate a pressure pulse detectable at the surface; and an active acoustic system for subsurface collision avoidance comprising an acoustic signal generator for producing an acoustic signal and adapted to fluctuate said acoustic signal in the presence of a metal obstruction; and an acoustic signal receiver for receiving said acoustic signal and adapted to communicate with said pulser for transmitting information from said acoustic signal.

Changes may be made in the combinations, operations, and arrangements of the various parts and elements described herein without departing from the spirit and scope of the invention. Furthermore, names, titles, headings and general division of the aforementioned are provided for convenience and should, therefore, not be considered limiting.

What is claimed is:

1. A wireless tool inserted down hole for providing drilling information during the drilling process comprising:

an electrical power source;

a pressure sensitive switch;

a sensor package;

a vibration sensitive switch;

a processor;

a pulser valve comprising:

a stator with inlet passages that are orthogonal to a longitudinal axis of a drill string and a plurality of holes that are in line with the longitudinal axis of said drill string;

a rotor which resides inside said stator and has cylindrical blade surfaces which in a first orientation allow said drilling fluid to flow unobstructed through the passages orthogonal to the longitudinal axis of said drill string and in a second orientation, the rotor is rotatable and the blades are used to create an obstruction in the path of fluid flow through the orthogonal slots and thus generate a pressure pulse detectable at the surface; and an active acoustic system for subsurface collision avoidance comprising:

an acoustic signal generator for producing an acoustic signal and adapted to fluctuate said acoustic signal in the presence of a metal obstruction; and an acoustic signal receiver for receiving said acoustic signal and adapted to communicate with said pulser for transmitting information from said acoustic signal.

* * * * *